US010471569B2

(12) United States Patent
Williams

(10) Patent No.: US 10,471,569 B2
(45) Date of Patent: Nov. 12, 2019

(54) SYSTEM AND METHOD FOR BLASTING AN OVERHEAD SURFACE

(71) Applicant: James Ray Williams, Vidor, TX (US)

(72) Inventor: James Ray Williams, Vidor, TX (US)

( * ) Notice: Subject to any disclaimer, the term of this patent is extended or adjusted under 35 U.S.C. 154(b) by 134 days.

(21) Appl. No.: 15/805,137

(22) Filed: Nov. 7, 2017

(65) Prior Publication Data

US 2019/0134777 A1 May 9, 2019

(51) Int. Cl.

| | |
|---|---|
| ***B24C 1/10*** | (2006.01) |
| ***B24C 3/06*** | (2006.01) |
| ***B24C 5/06*** | (2006.01) |
| ***B63B 59/06*** | (2006.01) |

(52) U.S. Cl.

CPC ..... *B24C 3/065* (2013.01); *B24C 1/10* (2013.01); *B24C 3/06* (2013.01); *B24C 5/06* (2013.01); *B24C 5/066* (2013.01); *B63B 59/06* (2013.01)

(58) Field of Classification Search

CPC .... B24C 1/00; B24C 1/10; B24C 3/06; B24C 3/065; B24C 5/06; B24C 5/066; B63B 59/06

USPC ..... 451/38, 40, 87, 88, 89, 92, 95, 97

See application file for complete search history.

(56) References Cited

U.S. PATENT DOCUMENTS

| | | | | |
|---|---|---|---|---|
| 3,900,969 | A * | 8/1975 | Diehn | B24C 3/065 451/87 |
| 3,934,372 | A * | 1/1976 | Diehn | B24C 3/065 451/88 |
| 4,020,596 | A * | 5/1977 | Bergh | B24C 3/065 451/88 |
| 5,441,443 | A * | 8/1995 | Roberts | B24C 3/062 451/100 |
| 5,779,524 | A * | 7/1998 | Swain | B24C 5/06 451/102 |
| 6,244,940 | B1 * | 6/2001 | Boulton | B24C 3/065 451/88 |
| 8,926,406 | B2 * | 1/2015 | Mrak | B24C 5/06 451/95 |
| 2003/0064668 | A1 * | 4/2003 | Mrak | B24C 3/065 451/88 |

* cited by examiner

*Primary Examiner* — Eileen P Morgan
(74) *Attorney, Agent, or Firm* — Spradley PLLC; Michael Spradley

(57) ABSTRACT

A system and method for blasting an overhead surface is disclosed herein. The blaster system can comprise a first enclosure, a second enclosure, a pair of recirculators, a pair of loader valves, and a pair of propeller assemblies. The first enclosure can comprise a pair of primary ports, and a pair of control cages. The pair of primary ports can be at the front surface of the first enclosure. The primary ports can receive abrasive material. The pair of control cages can be attached at the bottom surface of the first enclosure forming a pair of curved surfaces, and a plurality of gaps. Each of the curved surface can comprise a slot. Each end of the slot can rest within each of the gaps such that the abrasive material received within the first enclosure can collect within the gaps and falls into the slot.

19 Claims, 23 Drawing Sheets

SYSTEM AND METHOD FOR BLASTING AN OVERHEAD SURFACE

BACKGROUND

This disclosure relates to a system and method for blasting an overhead surface.

Methods for stripping paint from a metal surface have evolved over the years. Abrasive blasting is one of the popular methods known in such industry. Abrasive blasting method is performed by forcibly propelling a stream of abrasive material, such as shot and grit, to smoothen the selected surface. One of the popular devices used for abrasive blasting is a blasting cabinet. This method allows the user to blast a material within the blasting cabinet. Such method can be effective in recycling the abrasive material used. Moreover, using such method can contain the abrasive material, dust, and other particulates within the blasting cabinet. Thus, such method can keep the waste contained and can prevent contaminating the environment. However using such method can be restrictive to the size of the blasting cabinet and cannot be used to blast a larger object. Moreover, such method is usually kept at one place and is not mobile. Another method used for blasting is pressure blaster, which can be used to blast large objects and/or surfaces. In such methods, the abrasive material is released from a nozzle towards the selected surface. Thus, this method can be expensive, as it does not support recycling of abrasive material used. Additionally it can be inconvenient to use such method when blasting overhead surfaces.

As such it would be useful to have an improved system and method for blasting an overhead surface.

SUMMARY

A system and method for blasting an overhead surface is disclosed herein. The blaster system can comprise a first enclosure, a second enclosure, a pair of recirculators, a pair of loader valves, and a pair of propeller assemblies. The first enclosure can comprise a pair of primary ports, and a pair of control cages. The pair of primary ports can be at the front surface of the first enclosure. The primary ports can receive abrasive material. The pair of control cages can be attached at the bottom surface of the first enclosure forming a pair of curved surfaces, and a plurality of gaps. Each of the curved surface can comprise a slot. Each end of the slot can rest within each of the gaps such that the abrasive material received within the first enclosure can collect within the gaps and falls into the slot. The second enclosure can be attached to the first enclosure. The second enclosure can comprise an upper seal and a bottom opening. The upper seal can collect used abrasive material and waste material from an overhead surface. Each of the recirculator can comprise a hook, a neck, and a bottom cavity. The hook can attach the recirculators at the top opposite sides of the first enclosure. The neck can be connected below the hook. The neck can comprise an outlet port facing towards inner surface of the first enclosure. The outlet port can release the collected abrasive material back to the first enclosure. The bottom cavity can be at the bottom of the recirculators. The bottom cavity can comprise an inlet port positionable under the bottom opening. The inlet port can receive collected abrasive material from the second enclosure. Each of the loader valve can be within the bottom cavity of each of the recirculator. The loader valves can direct the abrasive material from the inlet port into the outlet port. The pair of propeller assemblies can each be mounted within each of the control cages. The propeller assemblies can comprise a chamber opening, a propeller, and a pair of electric motor assemblies. The chamber opening can be positioned under the slot. The chamber opening can release the abrasive material within the second enclosure. A propeller can be placed within the second enclosure that can propel the abrasive material released from the chamber opening. The pair of electric motor assemblies can of actuate said propeller.

A method of operating a blaster system is described herein. The method can comprise the steps of positioning the blaster system under an overhead surface, loading an abrasive material into a primary port, and turning on the blaster system to blast the overhead surface. The blaster system can comprise a first enclosure, a second enclosure, a pair of recirculators, a pair of loader valves, and a pair of propeller assemblies. The first enclosure can comprise a pair of primary ports, and a pair of control cages. The pair of primary ports can be at the front surface of the first enclosure. The primary ports can receive abrasive material. The pair of control cages can be attached at the bottom surface of the first enclosure forming a pair of curved surfaces, and a plurality of gaps. Each of the curved surface can comprise a slot. Each end of the slot can rest within each of the gaps such that the abrasive material received within the first enclosure can collect within the gaps and falls into the slot. The second enclosure can be attached to the first enclosure. The second enclosure can comprise an upper seal and a bottom opening. The upper seal can collect used abrasive material and waste material from an overhead surface. Each of the recirculator can comprise a hook, a neck, and a bottom cavity. The hook can attach the recirculators at the top opposite sides of the first enclosure. The neck can be connected below the hook. The neck can comprise an outlet port facing towards inner surface of the first enclosure. The outlet port can release the collected abrasive material back to the first enclosure. The bottom cavity can be at the bottom of the recirculators. The bottom cavity can comprise an inlet port positionable under the bottom opening. The inlet port can receive collected abrasive material from the second enclosure. Each of the loader valve can be within the bottom cavity of each of the recirculator. The loader valves can direct the abrasive material from the inlet port into the outlet port. The pair of propeller assemblies can each be mounted within each of the control cages. The propeller assemblies can comprise a chamber opening, a propeller, and a pair of electric motor assemblies. The chamber opening can be positioned under the slot. The chamber opening can release the abrasive material within the second enclosure. A propeller can be placed within the second enclosure that can propel the abrasive material released from the chamber opening. The pair of electric motor assemblies can of actuate said propeller. The method can further comprise the steps of receiving the waste material and the used abrasive material through the upper seal, receiving the used abrasive material on the inlet port positioned at the bottom of the second enclosure, directing the used abrasive material to the outlet port positioned at the opposite top side of the first enclosure through the loader valves on each of the recirculators, and reloading the used abrasive material on the slot.

DETAILED DESCRIPTION

Described herein is a system and method for blasting an overhead surface. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
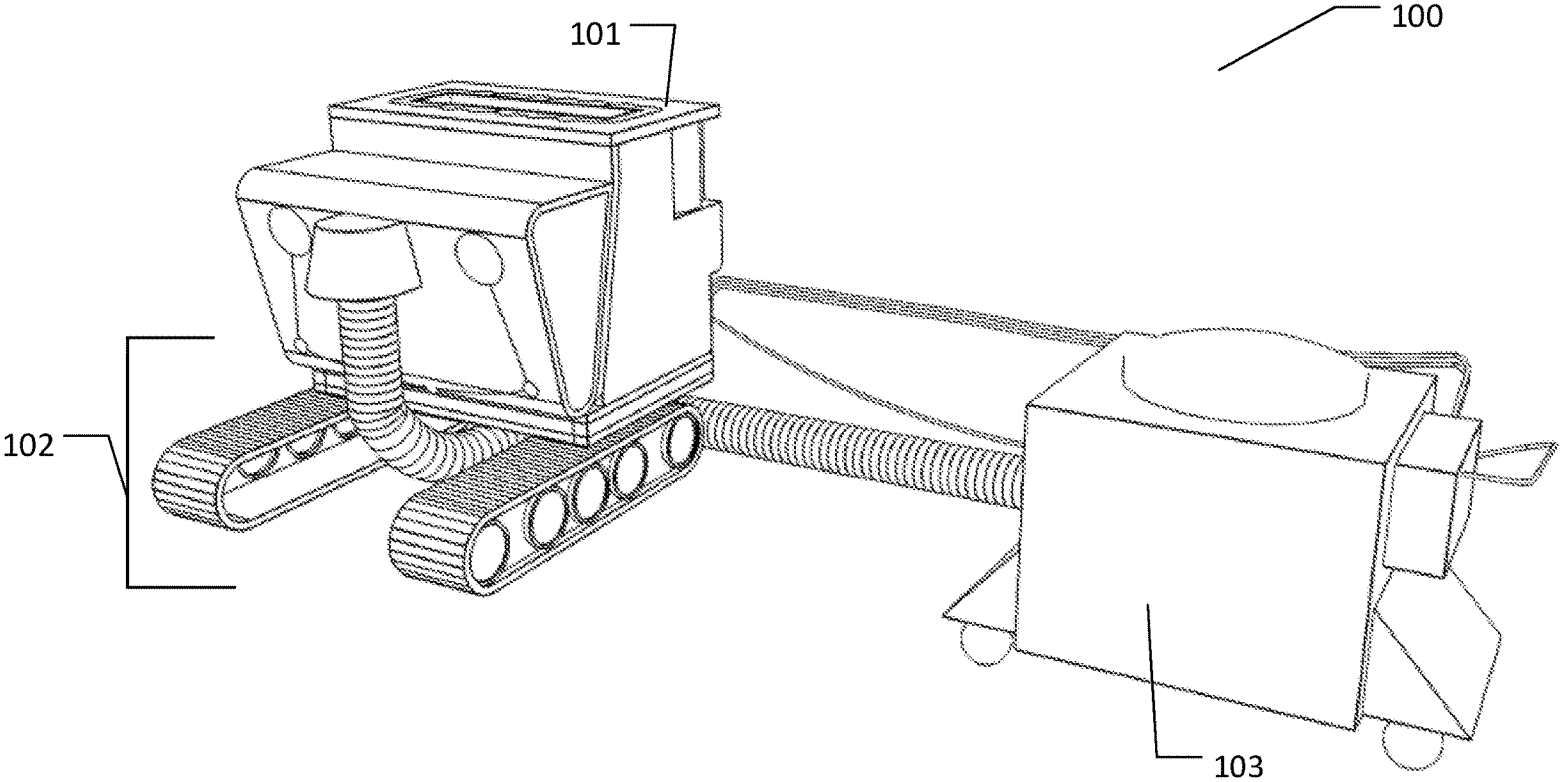
FIG. 1 illustrates a paint stripping system comprising a blaster, a buggy, and a dust collector.

FIG. 1 illustrates a paint stripping system 100 comprising a blaster 101, a buggy 102, and a dust collector 103. Paint stripping system 100 can remove paint, rust and can scale deposits down to the bare metal. In this embodiment, paint stripping system 100 can be a mobile system that is used to blast overhead surfaces such as a ship bottom. Blaster 101 can be used to propel stream of abrasive material against overhead surfaces. In a preferred embodiment, the abrasive material used is shot and grit. Buggy 102 can be used to maneuver blaster 101 to any desired location. Dust collector 103 can keep excess debris out of the atmosphere. Furthermore, paint stripping system 100 can recycle the abrasive material that is used during operation.

Figure 2:
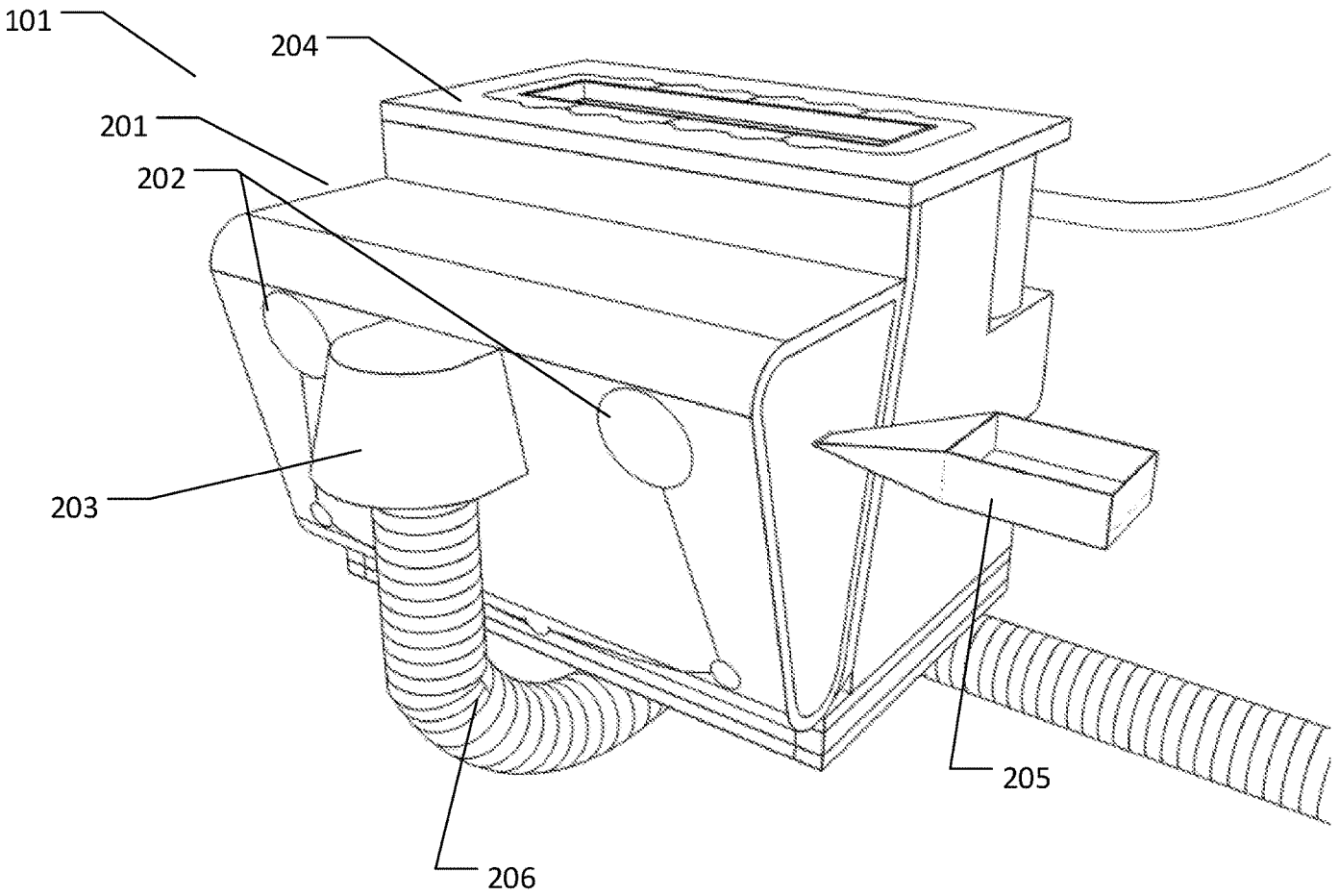
FIG. 2 illustrates a blaster comprising a casing.

FIG. 2 illustrates a blaster 101 comprising a casing 201. Casing 201 can house internal components of blaster 101. Front end of casing 201 can comprise a pair of primary ports 202, and a dust vent cover 203. The top surface of casing 201 can comprise a seal 204, which can cover and protect internal components of blaster 101. Primary loading ports 202 can be used to manually load the abrasive material into blaster 101. A funnel 205 can be used to pour the abrasive material into primary loading ports 202. Dust vent cover 203 can ensure that collected wastes materials and/or abrasive materials are kept within blaster 101. Waste materials can include dust, paints, and/or rust that are produced during blasting operation. Dust vent cover 203 can be placed near the top surface of casing 201 and in between primary loading ports 202. A vacuum hose 206 can be positioned at the bottom of dust vent cover 203.

Figure 3:
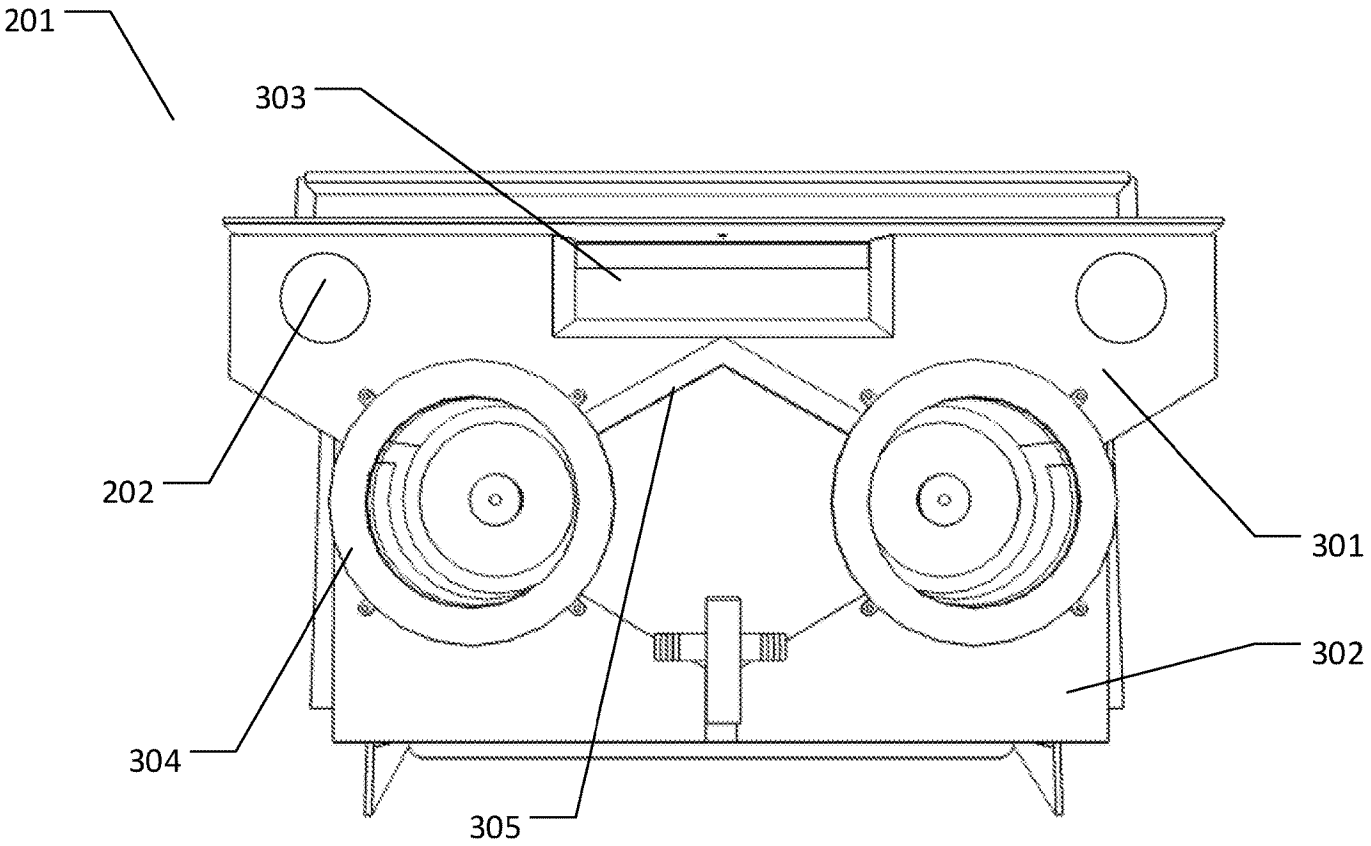
FIG. 3 illustrates a front view of a casing comprising a first enclosure, and a second enclosure.

FIG. 3 illustrates a front view of casing 201 comprising a first enclosure 301, and a second enclosure 302. First enclosure 301 can be the front section of casing 201, while second enclosure 302 can be the back section of casing 201. First enclosure 301 can attach near the top section of second enclosure 302. First enclosure 301 can be an inverted pyramidal shaped container, resembling the top portion of a hopper. First enclosure 301 can comprise a dust vent 303, a pair of control cages 304, and primary ports 202. Dust vent 303 can be placed near the middle top portion of first enclosure 301. In one embodiment, dust vent 303 can be rectangular in shape. Control cages 304 can be positioned at the bottom of first enclosure 301, such that each control cage 304 is placed at the opposite outer end of first enclosure 301. Control cage 304 can be separated with an inverted v-shaped liner 305. For purposes of this disclosure, liners can be made of durable material, such as steel.

Figure 4:
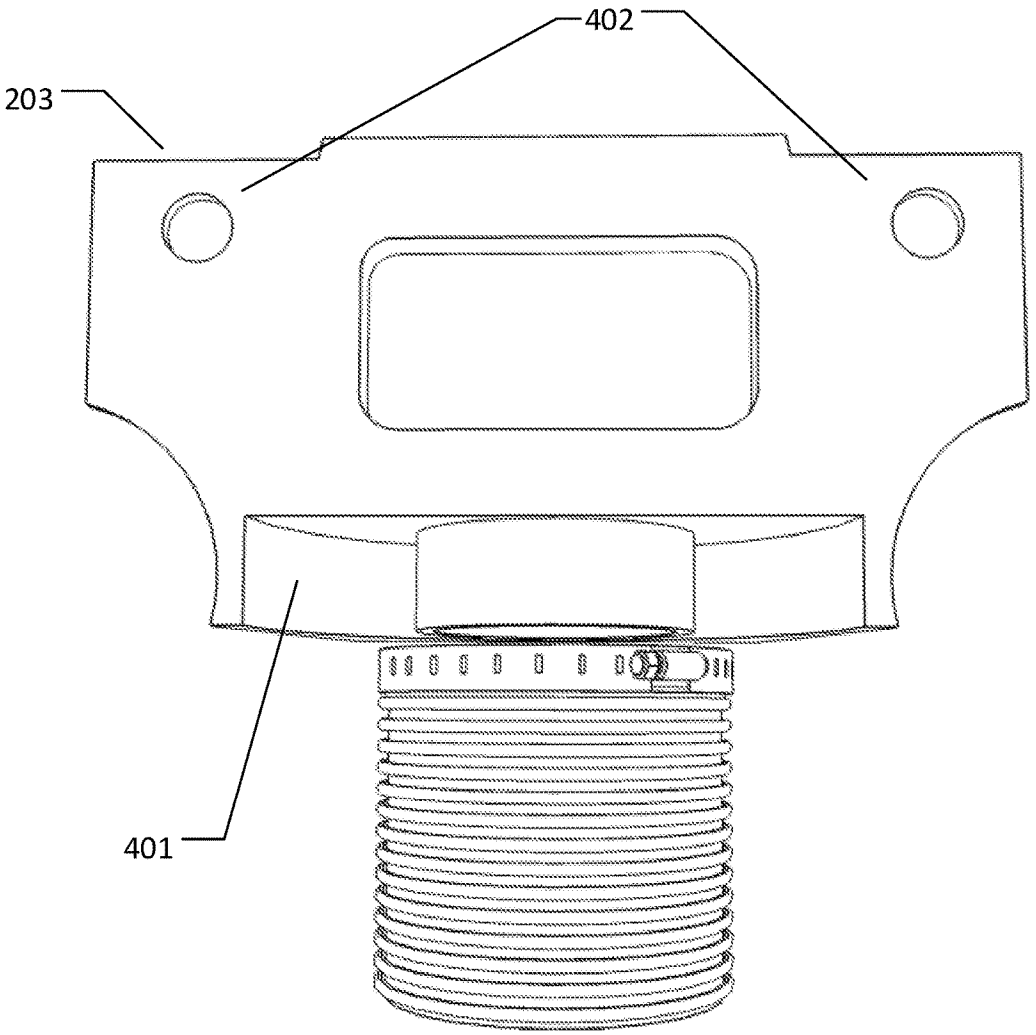
FIG. 4 illustrates a back view of a dust vent cover.

FIG. 4 illustrates a back view of dust vent cover 203. Dust vent cover 203 can comprise an opening 401, a pipe 402, and a pair of winged plate 403. Opening 401 can be openings at the back dust collector vent 203 that is large enough to enclose dust vent 303. Pipe 402 can attach at the bottom of dust vent cover 203. Pipe 402 can be a cylindrical shaft attached at the bottom of dust vent cover 203. Pipe 402 can allow attachment of vacuum hose 206 with dust vent cover 203. In a preferred embodiment, vacuum hose 206 can connect at the bottom of pipe 402 through a fastener, such as a hose clamp. Each winged plate 403 can attach at the opposite side of dust vent cover 203. In one embodiment, winged plate 403 can be a flat material, which can allow attachment of dust collector vent 206 the front surface of casing 201 through method that can include but is not limited to adhesion, molding, fastening, and/or cementing.

Figure 5A:
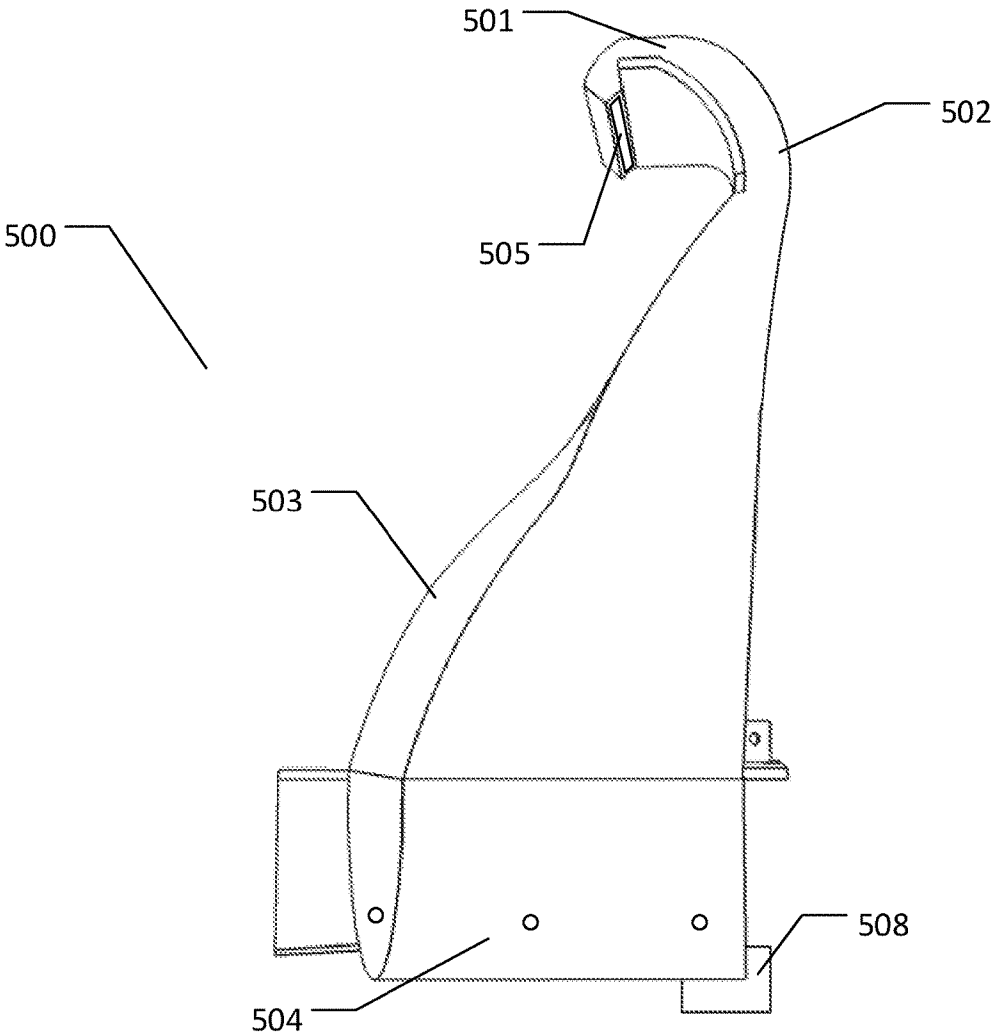
FIG. 5A illustrates a front view of a recirculator.

FIG. 5A illustrates a front view of a recirculator 500. Recirculator 500 can recirculate the abrasive materials that are collected through upper seal 204. Recirculator 500 can comprise a hook 501, a neck 502, a body 503, and a bottom cavity 504. Hook 501 can be at the top end of recirculator 500. Hook 501 can attach at a side of casing 201. Neck 502 can be an elongated portion that connects hook 501 with body 503. Inner side of neck 502 can comprise an outlet port 505. Recirculator 500 can be positioned at the topside portion of first enclosure 301 such that outlet port 505 is within first enclosure 301. The inner side surface of body 503 can curve outwards towards bottom cavity 504. Bottom cavity 504 can connect at the bottom of body 503. Furthermore, bottom cavity 504 can be the wider section of recirculator 500.

Figure 5B:
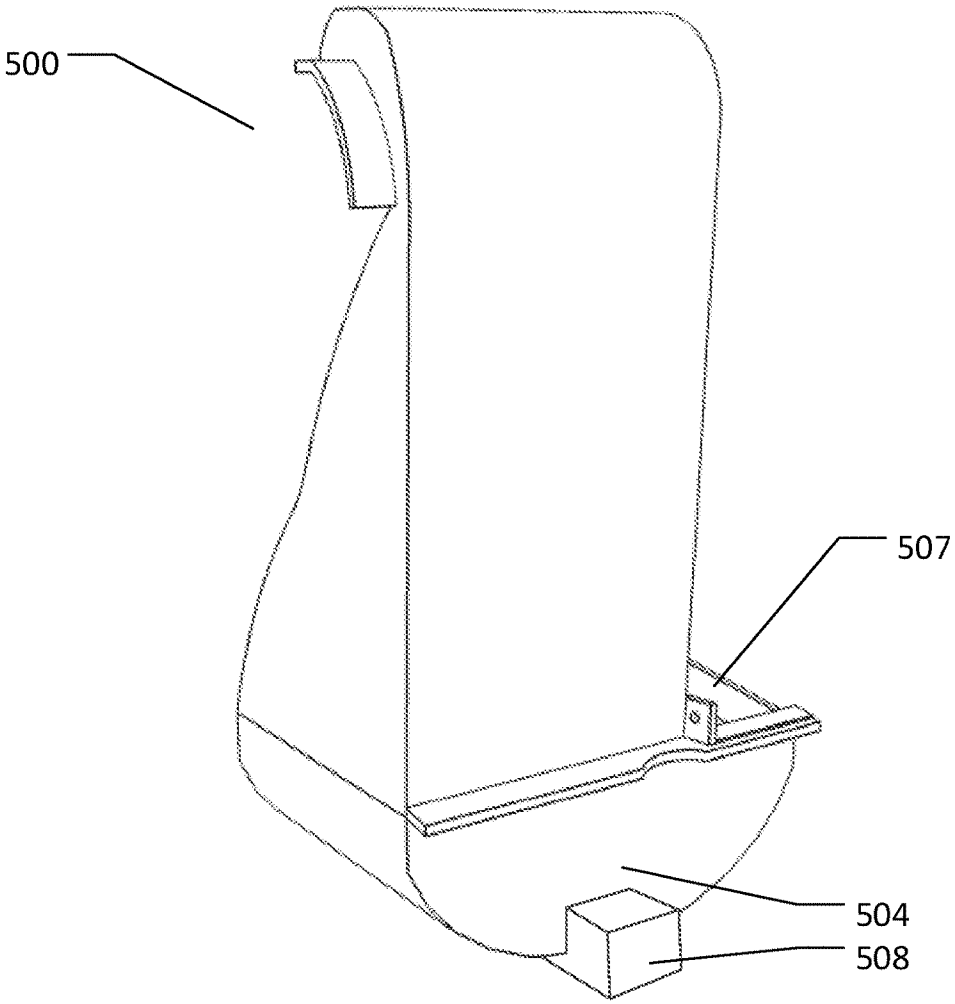
FIG. 5B illustrates the back portion of a bottom cavity comprising an insert.

FIG. 5B illustrates the back portion of bottom cavity 504 comprising an insert 506. Insert 506 can protrude at the back portion of bottom cavity 504. Insert 506 can comprise an inlet port 507. Inlet port 507 can be an opening that leads to bottom cavity 504.

Figure 5C:
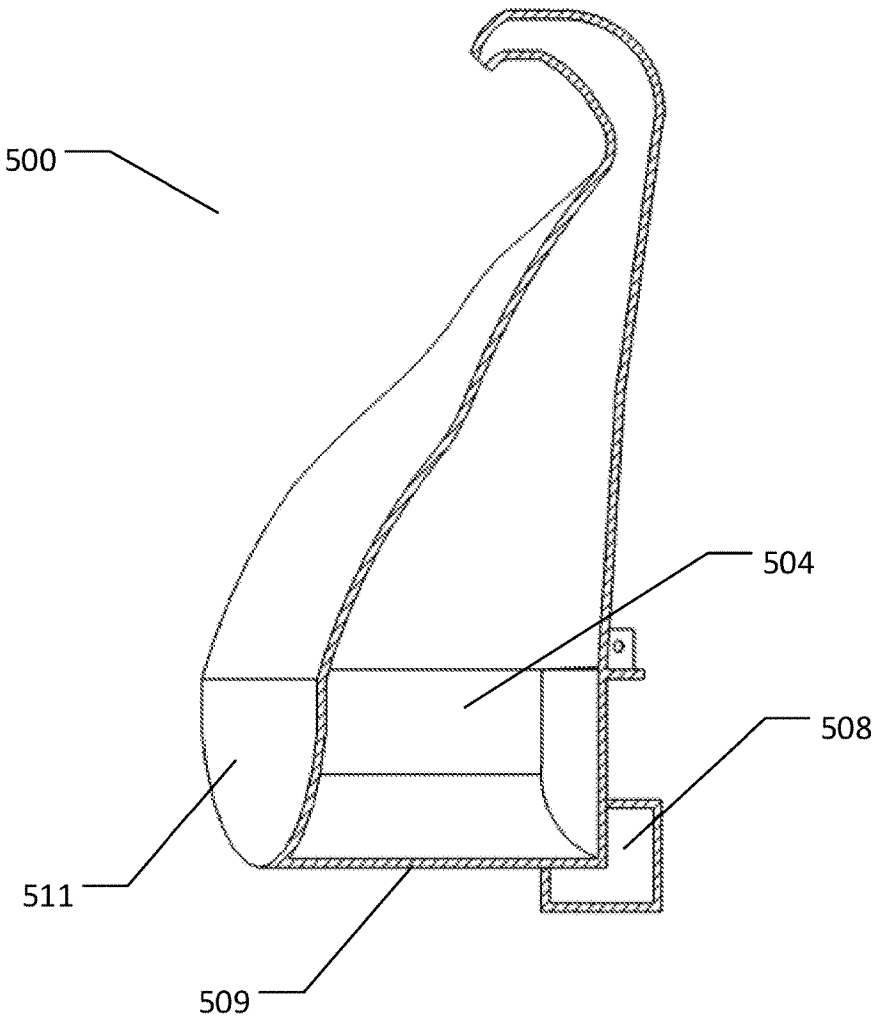
FIG. 5C illustrates a front-sectional view of a recirculator.

FIG. 5C illustrates a front-sectional view of recirculator 500. Inner section of recirculator 500 can comprise a collector box 508, a valley slope 509, a half-pipe liner 510, and a bottom cavity liner 511. Collector box 508 can be placed within the outer side portion of bottom cavity 504. Valley slope 509 can be at the bottom surface of bottom cavity 504. Outer end of valley slope 509 can connect to collector box 508. Moreover, valley slope 509 can slant downwards towards collector box 508, such that any abrasive material that falls into valley slope 509 can roll down to collector box 508. Half-pipe liner 510 can resemble the shape of half-pipe. Bottom cavity liner 511 can be a liner placed within the inner end of bottom cavity 504.

Figure 5D:
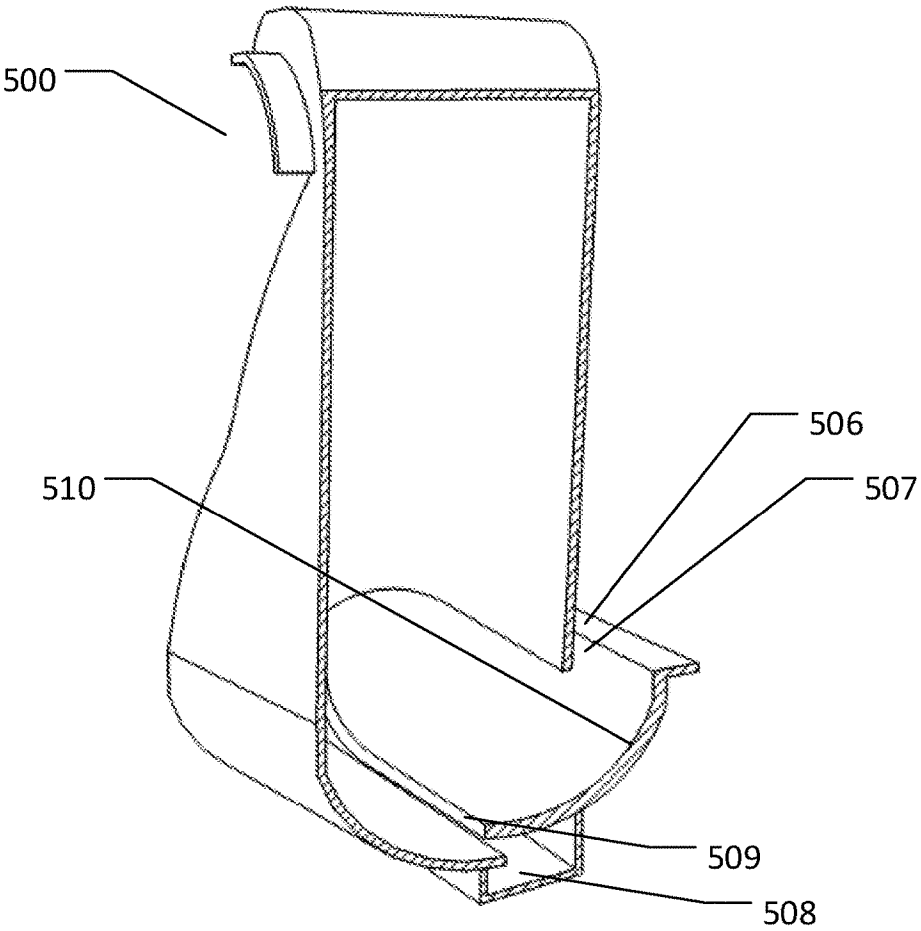
FIG. 5D illustrates a side-sectional view of recirculator.

FIG. 5D illustrates a side-sectional view of recirculator 500. First deck 513*a* can be placed within insert 506, while second deck 513*b* can be at the opposite side of first deck 513*a*. As abrasive material enters inlet port 507, the abrasive material can swing from first deck 513*a* through flat bottom 512 towards second deck 513*b*, and vice versa. The rocking of the abrasive material within half-pipe liner 510 can increase speed of the abrasive material. As the abrasive material gains speed, the abrasive material can rise upward towards neck 502 and then goes out of outlet port 505.

Figure 6:
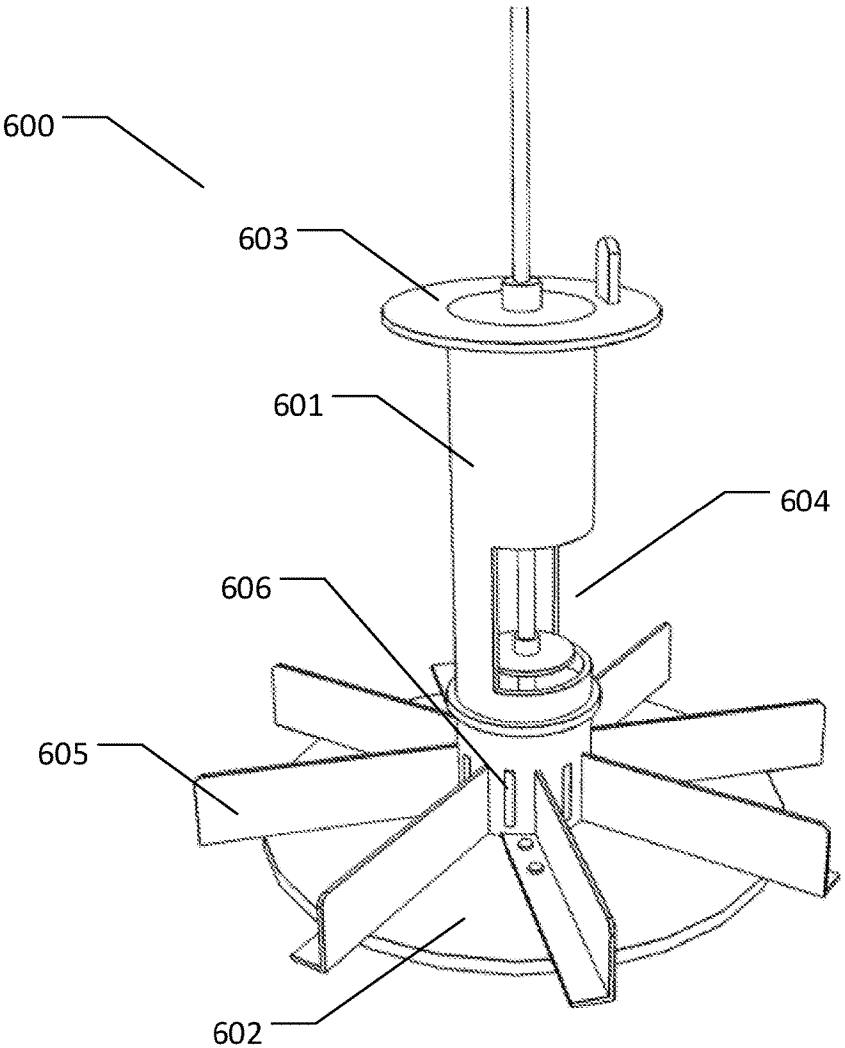
FIG. 6 illustrates a propeller assembly comprising a chamber.

FIG. 6 illustrates a propeller assembly 600 comprising a chamber 601. Propeller assembly 600 can propel the abrasive materials towards a blasting surface. One end of chamber 601 can be sealed with a circular plate 603, while the other end of chamber 601 can comprise a propeller 602. The surface near propeller 602 can comprise a chamber opening 604. Propeller 602 can comprise a plurality of blades 605. The gaps in between blades 505 can comprise one or more propeller orifices 606.

Figure 7:
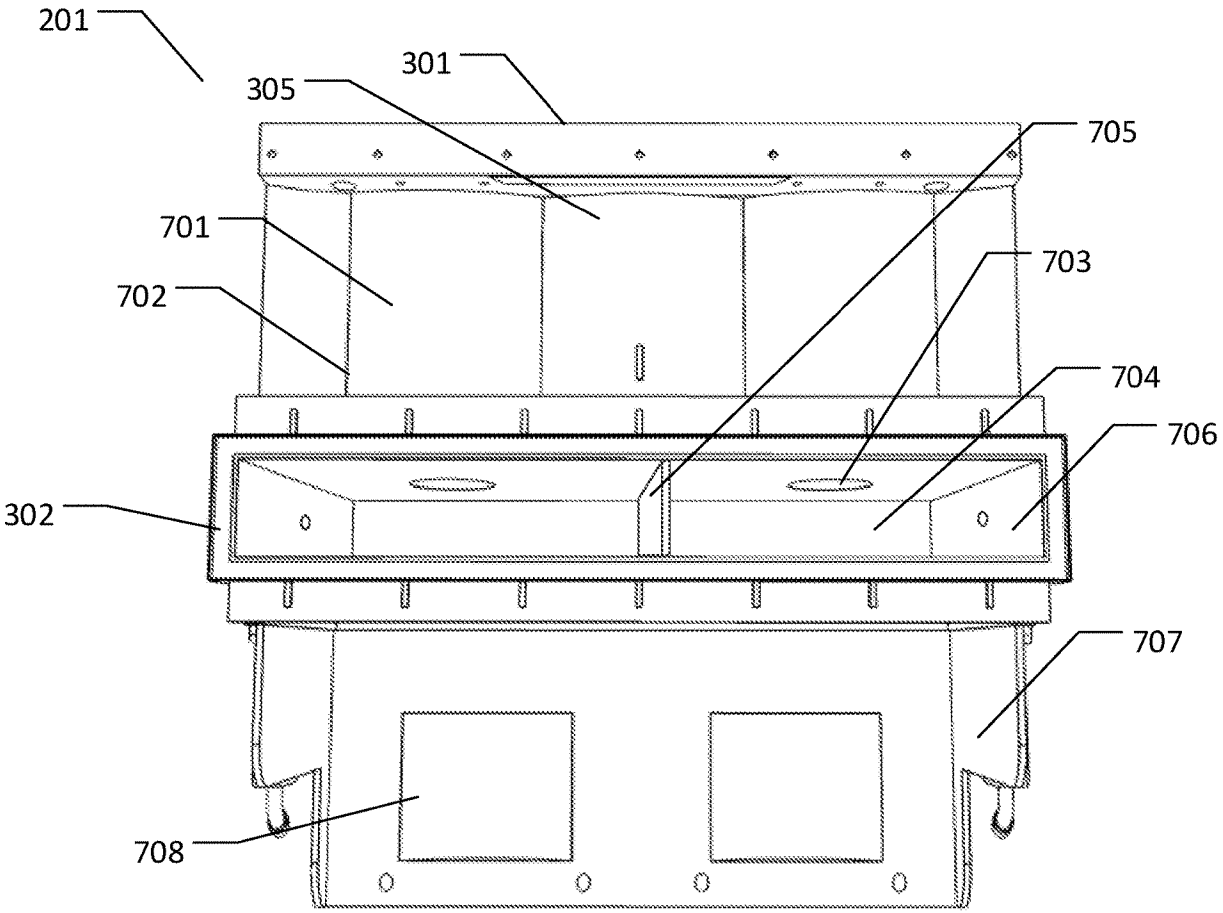
FIG. 7 illustrates a top view of a casing.

FIG. 7 illustrates a top view of casing 201. The bottom surface of first enclosure 301 can comprise liner 305, a pair of curved surface 701. Each curved surface 701 can be concave shaped bottom surface of first enclosure 301, which is positioned on top of each control cage 304. Each curved surface 701 can be at the opposite sides of first enclosure 301. Moreover, each curved surface 701 can be separated with liner 305. Thus, the lowest ends of each curved surface 701 can comprise a pair of gaps 702. Second enclosure 302 can comprise a pair of holes 703, a bottom opening 704, a center liner 705, and a pair of sideliners 706. Holes 703 can be placed at the front side of second enclosure 302 that attaches to the back surface of first enclosure 301. Each hole 703 can be directly in front of each control cage 304. Bottom opening 704 can be the hole at the bottom of second enclosure 302. Center liner 705 can be a thin sheet material that divides the left and right section of second enclosure 302. Sideliners 706 can be placed at the opposite sides of second enclosure 302. Casing 201 can also comprise a motor casing 707. Motor casing 707 can attach at the outer surface of the opposite side of second enclosure. Motor casing 707 can be an L-shaped casing capable of securing motor. The bottom surface of motor casing 707 can comprise a pair of depressed portions 708.

Figure 8:
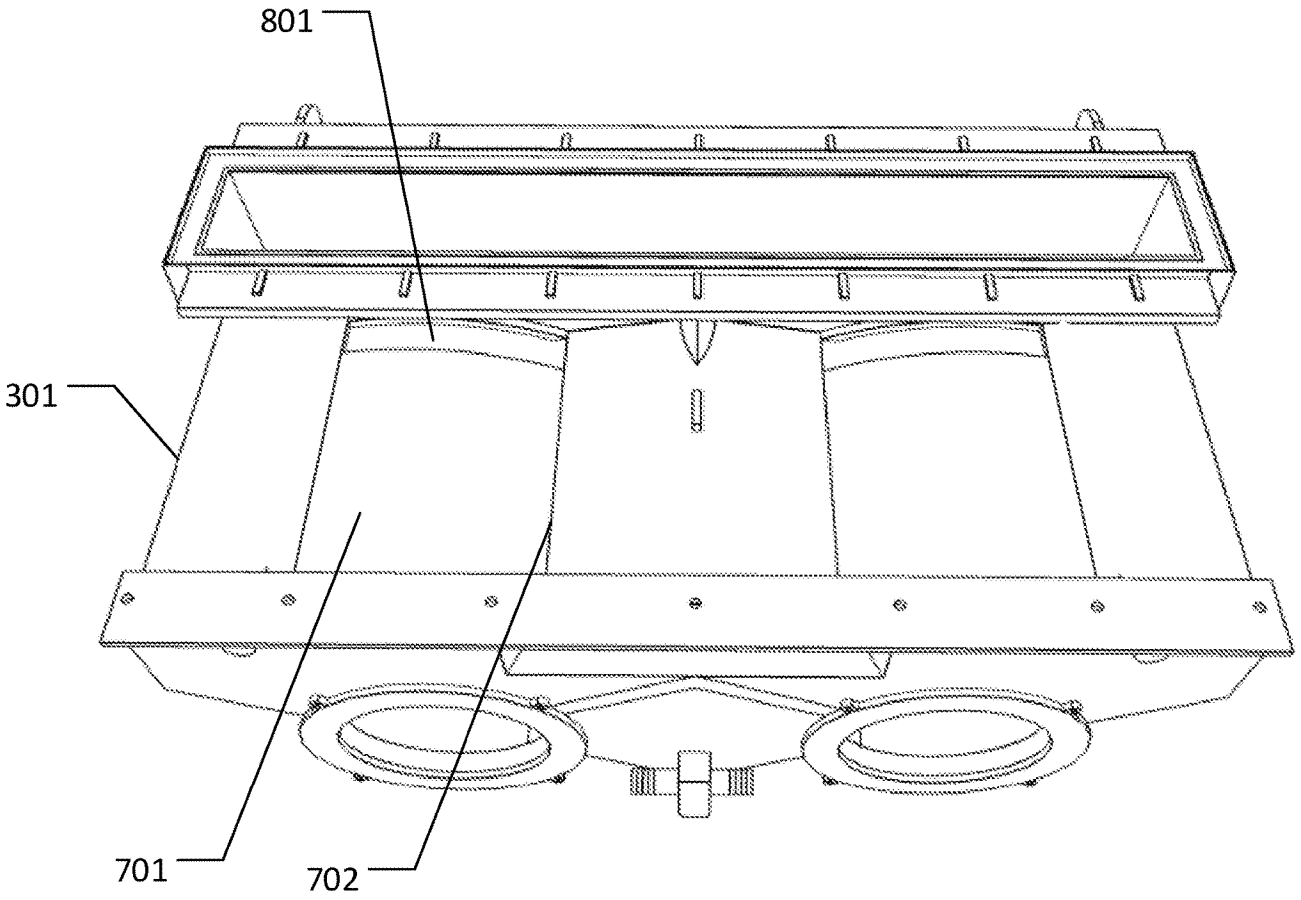
FIG. 8 illustrates a first enclosure comprising a pair of slots.

FIG. 8 illustrates first enclosure 301 comprising a pair of slots 801. Each slot 801 can be placed at the rear end of each curved surface 701 such that each ends of slot 801 can rest within each pair of gaps 702.

Figure 9A:
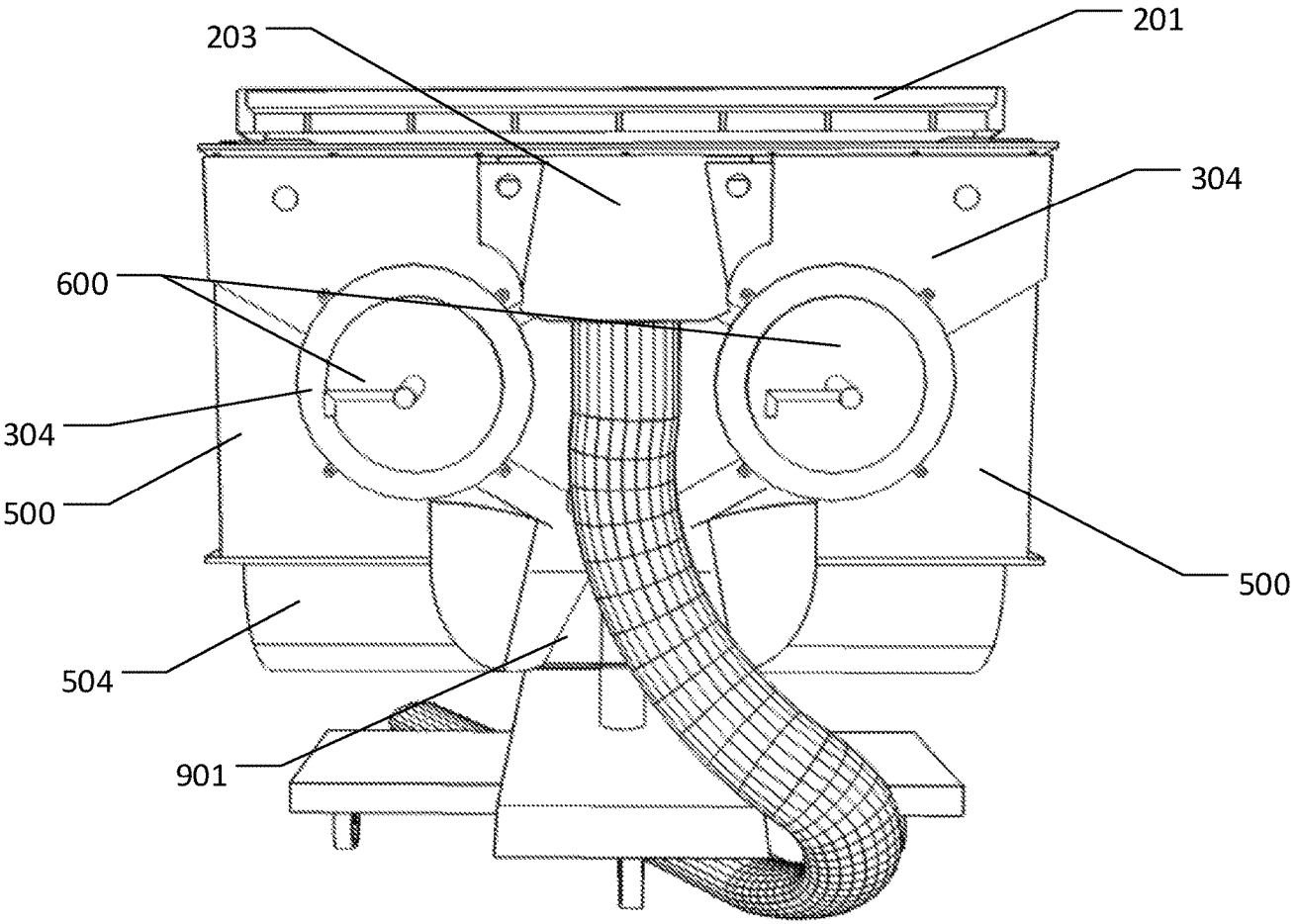
FIG. 9A illustrates a front view of a casing mounted with a dust vent cover, a pair of recirculators, and a pair of propeller assemblies.

FIG. 9A illustrates a front view of casing 201 mounted with dust vent cover 203, a pair of recirculators 500, and a pair of propeller assemblies 600. Dust vent cover 203 can attach in front of dust vent 303. Hook 501 of each recirculator 500 can attach at the top of each opposite side of first enclosure 301. The inward curves of body 503 can allow body 503 be positioned along side each control cage 304. Furthermore, bottom cavity 504 of each recirculator 500 can be positioned under each control cage 304. A void 901 can be formed in between bottom cavity 504 of each recirculator 500.

Figure 9B:
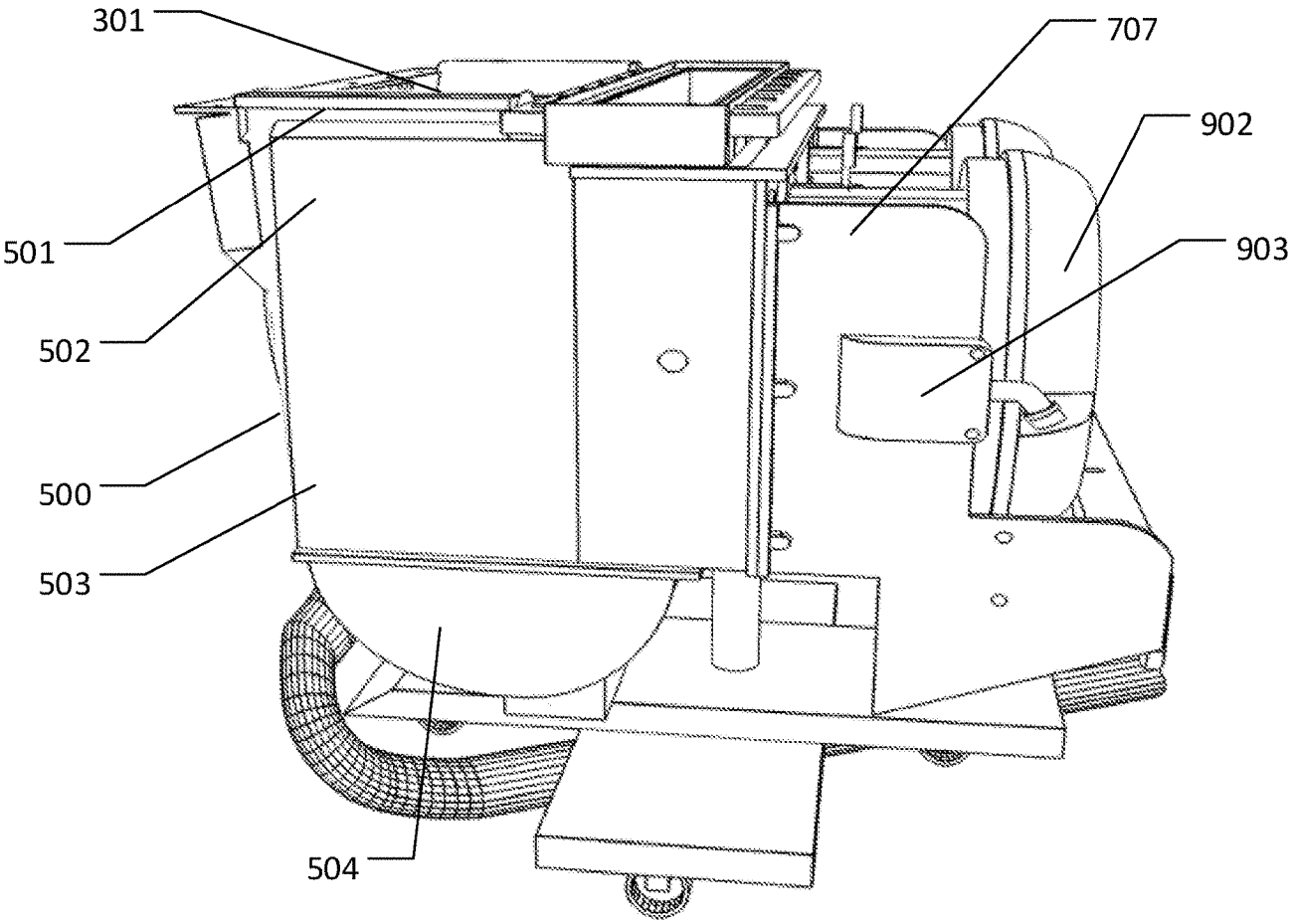
FIG. 9B illustrates a side view of a blaster.

FIG. 9B illustrates a side view of blaster 101. Hook 501, neck 502, and body 503 of each recirculator 500 can rest at the opposite sides of first enclosure 301. The front portion of bottom cavity 504 can rest at the bottom of body 503 while the back portion of bottom cavity 504 can be placed under second enclosure 302, such that insert 506 can be placed within the bottom portion of second enclosure 302. In such structure, bottom opening 704 on second enclosure 302 can be enclosed by bottom cavity 504 of each recirculator 500. Further, motor casing 707 can comprise a pair of electric motor assemblies 902. Each electric motor assembly 902 can provide electrical energy to each propeller assembly 600. Each motor assembly 902 can comprise a motor connection box 903. Motor connection box 903 can house electrical connection for motor assembly 902. Each electric motor assembly 902 can be powered by 30 HP motor.

Figure 10A:
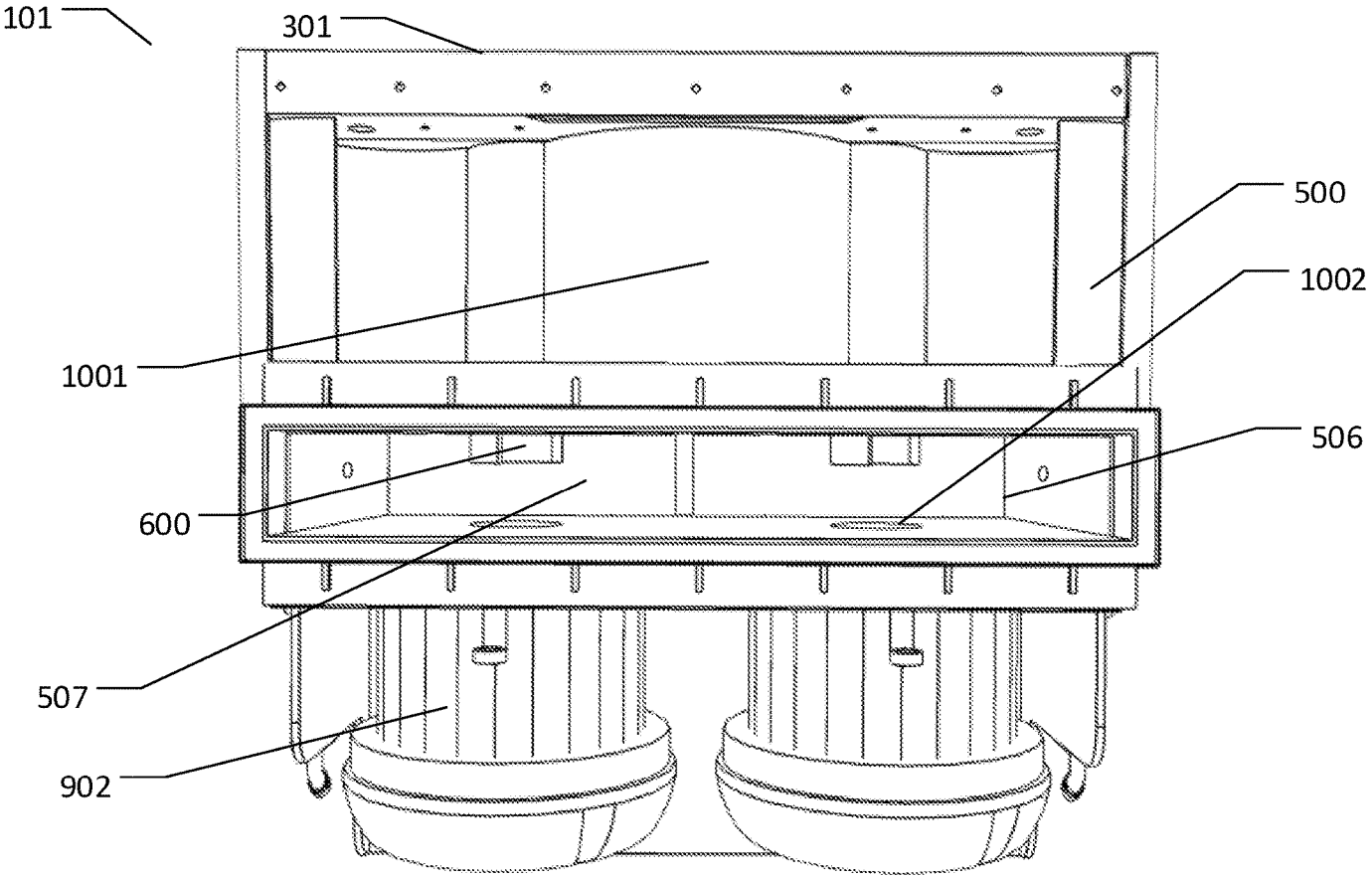
FIG. 10A illustrates a top view of a blaster.

FIG. 10A illustrates a top view of blaster 101 mounted with recirculators 500, propeller assemblies 600 and electric motor assemblies 902. First enclosure 301 can further comprise a deflector shield 1001. Deflector shield 1001 can enclose dust vent 203 and liner 305. Further, the other end of each chamber 601 can be inserted through each hole 703 of second enclosure 302. Each electric motor assembly 902 can comprise a flange seal 1002. Flange seal 1002 can attach at the back end of second enclosure 302. Furthermore, insert 506 of each recirculator 500 can be inserted at the bottom of second enclosure 302. In such structure, inlet port 507 of each recirculator can be positioned directly under bottom opening 704, wherein insert 506 can cover the entire bottom portion of second enclosure 302.

Figure 10B:
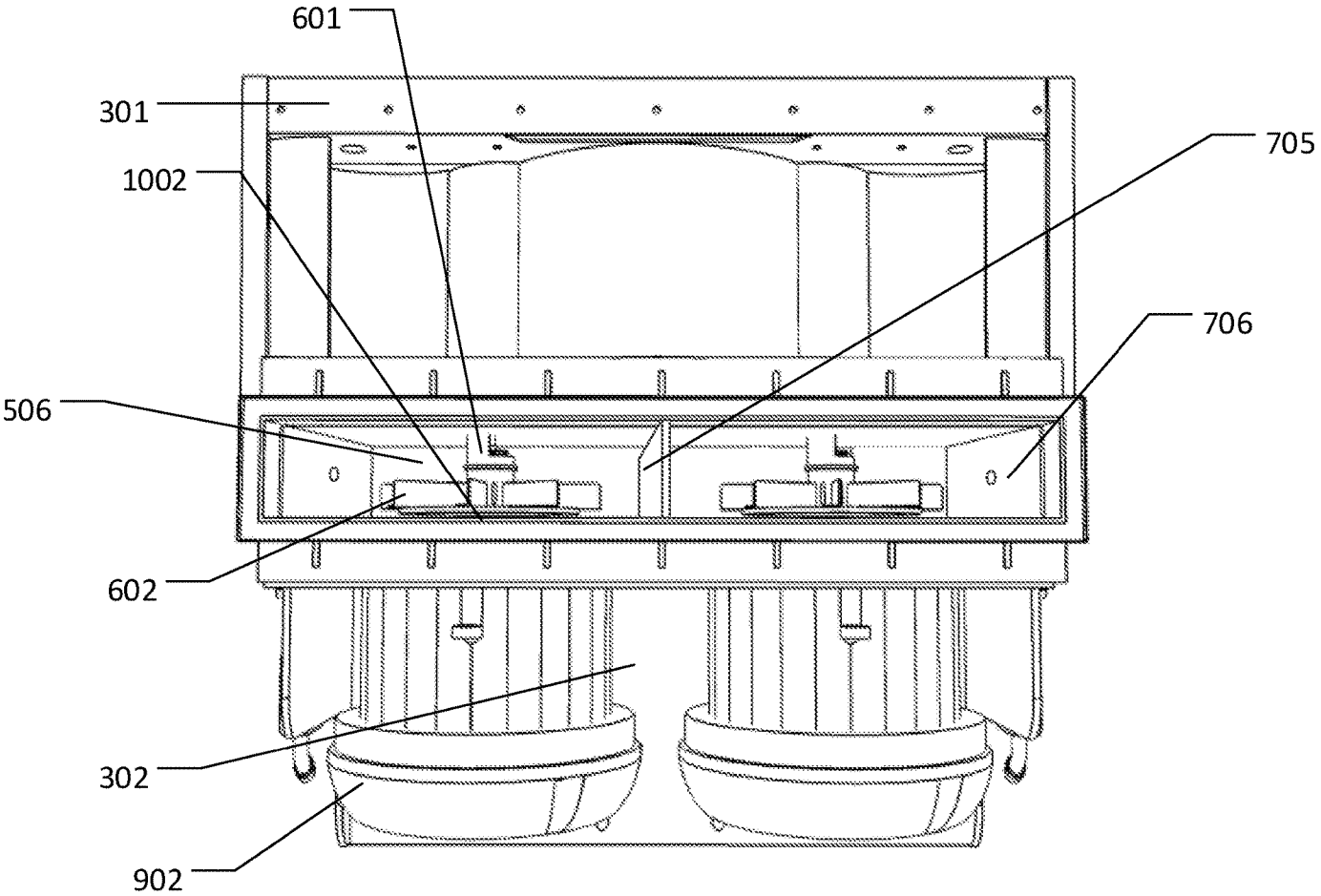
FIG. 10B illustrates propeller assemblies within a second enclosure.

FIG. 10B illustrates propeller assemblies 600 within second enclosure 302. Once the other ends of each chamber 601 are within enclosure 302, each propeller 602 can be attached on each other ends of chamber 601. Furthermore, center liner 705 can separate each propeller assembly 600. Moreover center liner 705 can separate inserts 506 of each recirculator 500. In such structure, the other ends of each chamber 601 that comprises propeller 602 can connect to each electric motor assembly 902 through flange seal 1002. Furthermore, the rear portion of chamber opening 604 can be positioned under slot 801 of first enclosure 301.

Figure 11:
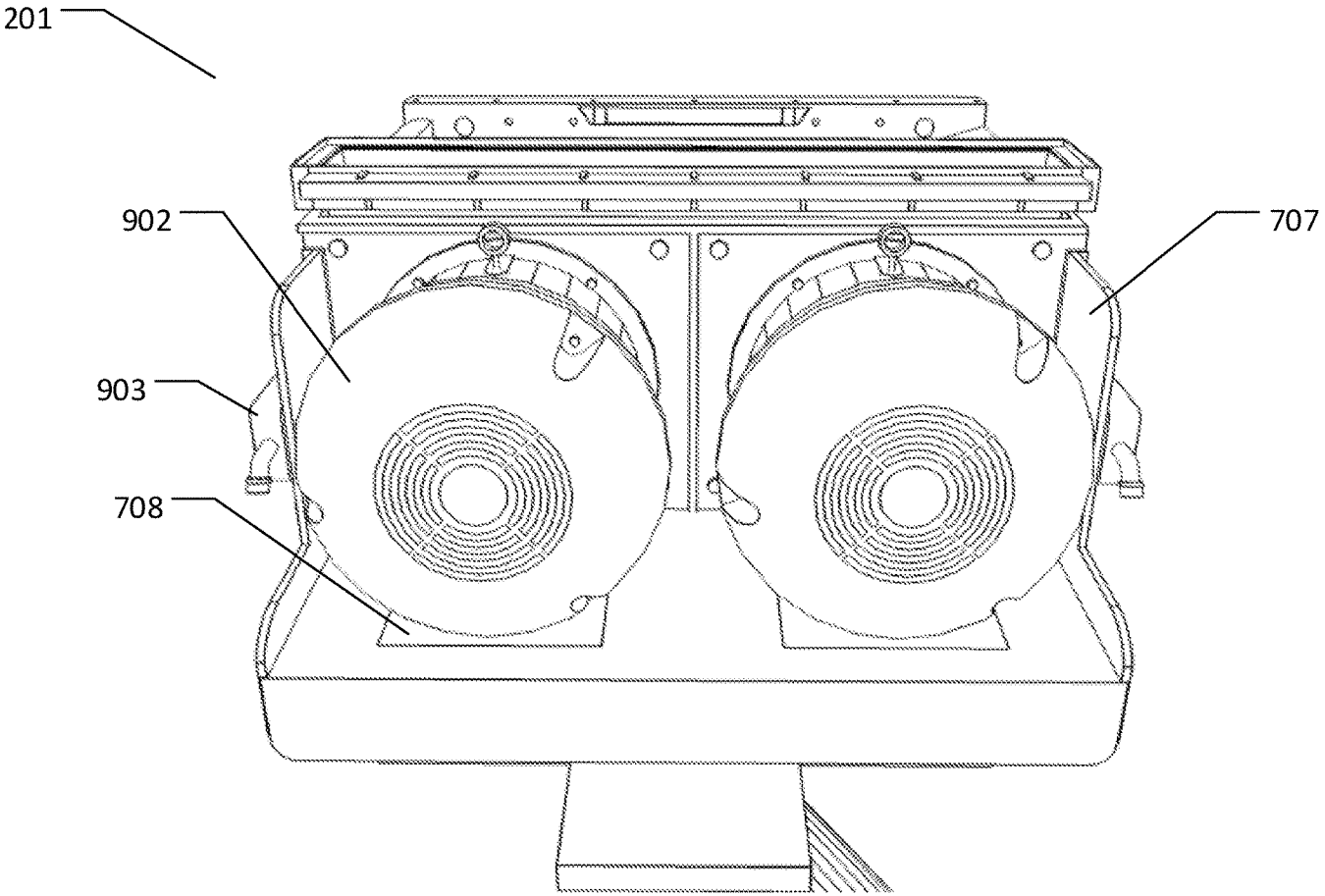
FIG. 11 illustrates a front view of electric motor assemblies mounted within a casing.

FIG. 11 illustrates a front view of electric motor assemblies 902 mounted within casing 201. The front end of electric motor assemblies 902 can rest within depressed portions 708. Each motor connection box 903 can attach at the outer opposite sides of electric motor assemblies 902.

Figure 12:
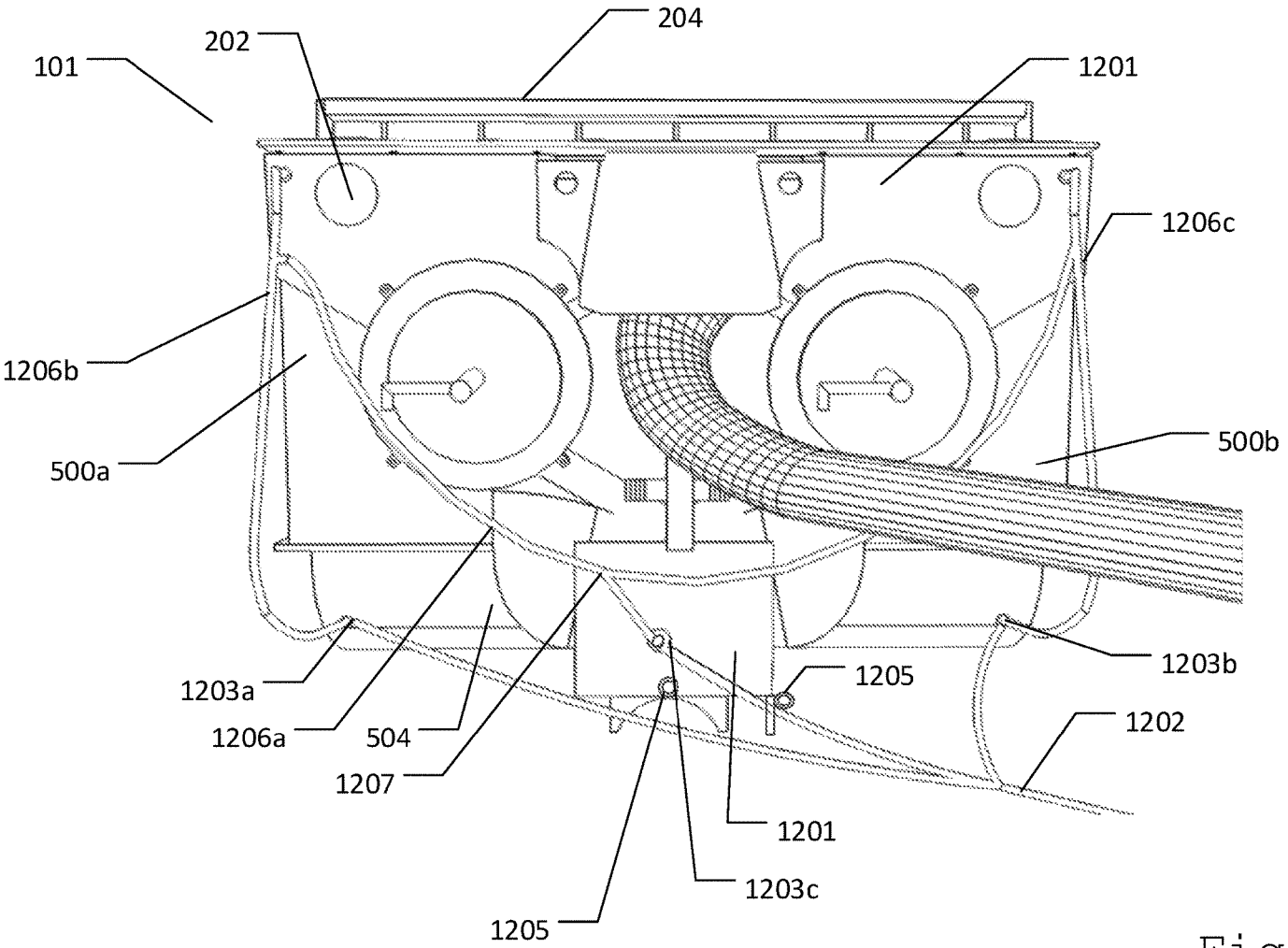
FIG. 12 illustrates a blaster further comprising a shot box, an air supply hose, and a plurality of loader valves.

FIG. 12 illustrates blaster 101 further comprising a shot box 1201, an air supply hose 1202, and a plurality of loader valves 1203. Shot box 1201 can be positioned within void 901, in between bottom cavity 504 of recirculators 500. Shot box 1201 can house abrasive materials. Loader valves 1203 can directing abrasive material into specific areas within blaster 101. In one embodiment, each loader valve 1203 can be a pneumatic valve. A left recirculator 500*a* can comprise a first loader valve 1203*a*, and a right recirculator 500*b* can comprise a second loader valve 1203*b*. Furthermore, shot box 1201 can comprise a third loader valve 1203*c*. Further, the bottom surface of blaster 101 can comprise a blaster-mounting bracket 1204, and a pair of first fasteners 1205. Fasteners 1205 can be any type of fastener that is compatible with a turnbuckle, such as an eyebolt, or a turnbuckle eye. Blaster-mounting bracket 1204 can be positioned at the bottom center of blaster 101. In one embodiment, blaster-mounting bracket 1204 can be positioned under shot box 1201. First fasteners 1205 can be attached on blaster-mounting bracket 1204. Air supply hose 1202 can be a hose capable of supplying air to areas within blaster 101. Air supply hose 1202 can comprise a plurality of y-connector 1206, a recycling hose 1207, and a t-connector 1208. A first y-connector 1206*a* can connect neck 502 of left recirculator 500*a* and neck 502 of right recirculator 500*b* with one end of recycling hose 1207. The other end of recycling hose 1207 can connect to third loader valve 1203*c* on shot box 1201. A second y-connector 1206*b* can connect neck 502 of left recirculator 500*a*, recycling hose 1207, with first loader valve 1203*a* that is within bottom cavity 504 of left recirculator 500*a*. A third y-connector 1206*c* can connect neck 502 on right recirculator 500*b*, and recycling hose 1207, with second loader valve 1203*b* that is within right recirculator 500*b*.

Figure 13:
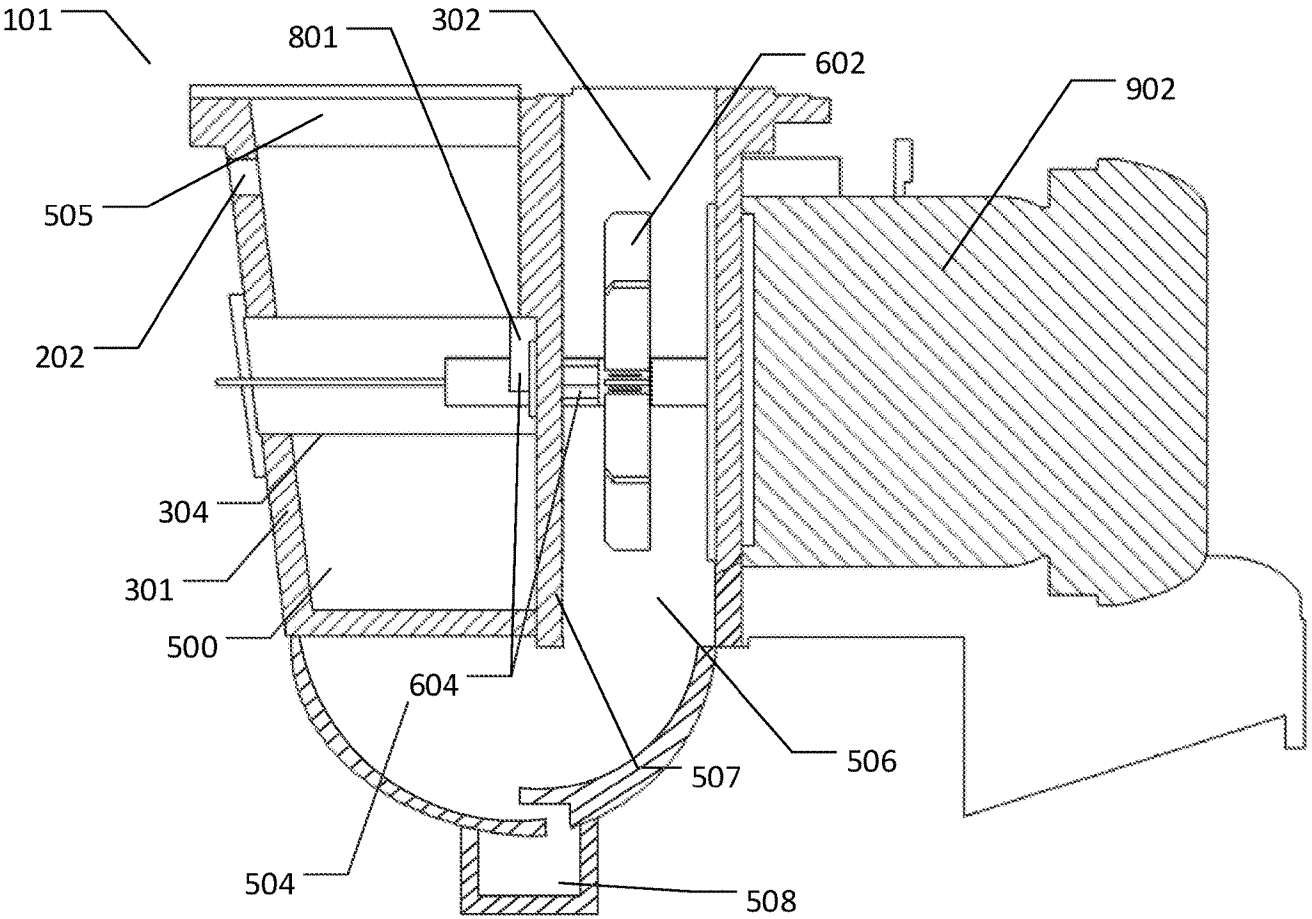
FIG. 13 illustrates a sectional view of blaster.

FIG. 13 illustrates a sectional view of blaster 101. Initially, the abrasive material can be loaded into primary ports 202. In one embodiment, funnel 205 can be used to pour the abrasive into blaster 101. In another embodiment, the abrasive can be loaded into blaster 101 pneumatically. In these embodiments, the abrasive material can be loaded into first enclosure 301. The abrasive material can collect within gaps 702 and into slot 801. The abrasive material can then be released from the front portion of chamber opening 604. During operation, the motion made by propeller 602 as actuated by electric motor assemblies 902, can hit the abrasive material that can cause abrasive material to bounce around second enclosure 302. The abrasive materials that are thrown upwards can hit the blasting surface. The other abrasive materials thrown within second enclosure 302 can end up at the bottom of second enclosure 302 and enter recirculators 500 through inlet port 507. In one scenario, abrasive material that enters inlet port 507 can roll through half-pipe liner 510. The abrasive material can then rock back and forth through half-pipe liner 510 until the speed of abrasive material allows the abrasive material to rise up towards neck 502 and then out of recirculator 500 through outlet port 505. As such, the abrasive materials can collect within first enclosure 301. In another scenario, abrasive material that enters bottom cavity 504 can fall into valley slope 509 and then rolls down to collector box 509. Then, loader valves 1203 on bottom cavity 504 can allow the abrasive material that ends in bottom cavity 504 to be recycled. Loader valves 1203*a* and 1203*b* can direct the abrasive material into first enclosure 301. Then the process of recycling the abrasive material can be repeated again as the abrasive material enters first enclosure 301.

Figure 14:
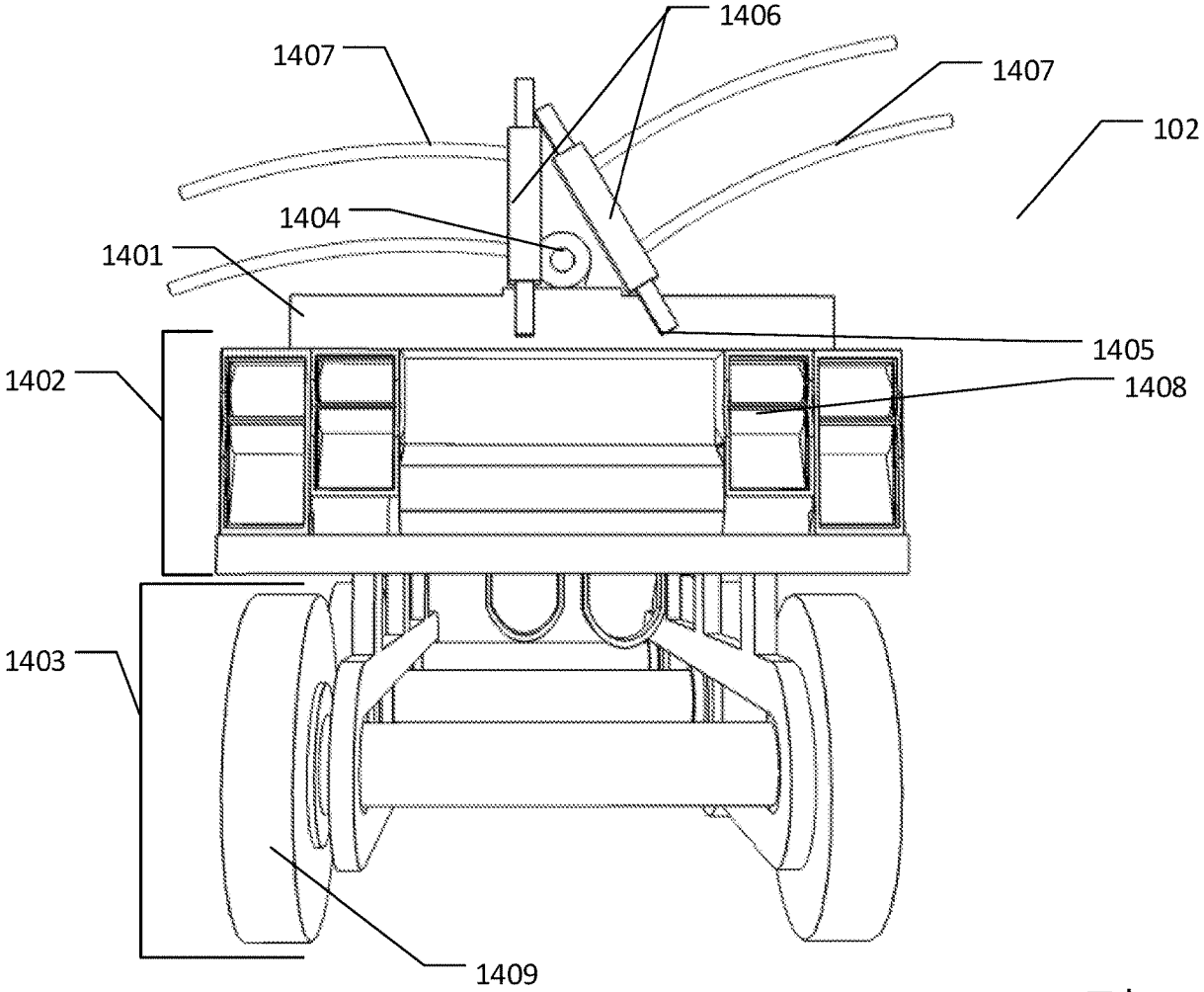
FIG. 14 Illustrates a buggy.

FIG. 14 illustrates a buggy 102 comprising a platform 1401, a scissor lift 1402, and a steering system 1403. Platform 1401 can comprise a platform-mounting bracket 1404, a pair of second fasteners 1405. Platform-mounting bracket 1404 can be attached at the center top surface of platform 1401. Furthermore, platform-mounting bracket 1404 can be mateable with blaster-mounting bracket 1204, which can attach blaster 101 with buggy 102. Second fasteners 1405 and first fasteners 1205 can be attached together through fasteners such as turnbuckles. In one embodiment, platform-mounting bracket 1404 can further comprise a pair of air rams 1406. Each air ram 1406 can comprise a pair of air ram hose 1407. Scissor lift 1402 can be any type of elevating platform device capable of extending and retracting vertically. In one embodiment, scissor lift 1402 can be controlled using an actuator 1408. In one embodiment, actuator 1408 can be a hydraulic lift that is powered by air compressors. In another embodiment, actuator 1408 can be an electric screw jack. In such embodiments, scissor lift 1402 can be capable of raising, and/or lowering platform 1401. Steering system 1403 can be any type of steering system that comprises a plurality of wheels 1409. Steering system 1403 can provide ability to maneuver platform 1401 in any direction. Platform 1401 can attach at the top surface of scissor lift 1402 while, steering system 1403 can attach at the bottom surface of scissor lift 1402 through methods that can include but is not limited to welding, soldering, fastening, and/or cementing.

Figure 15:
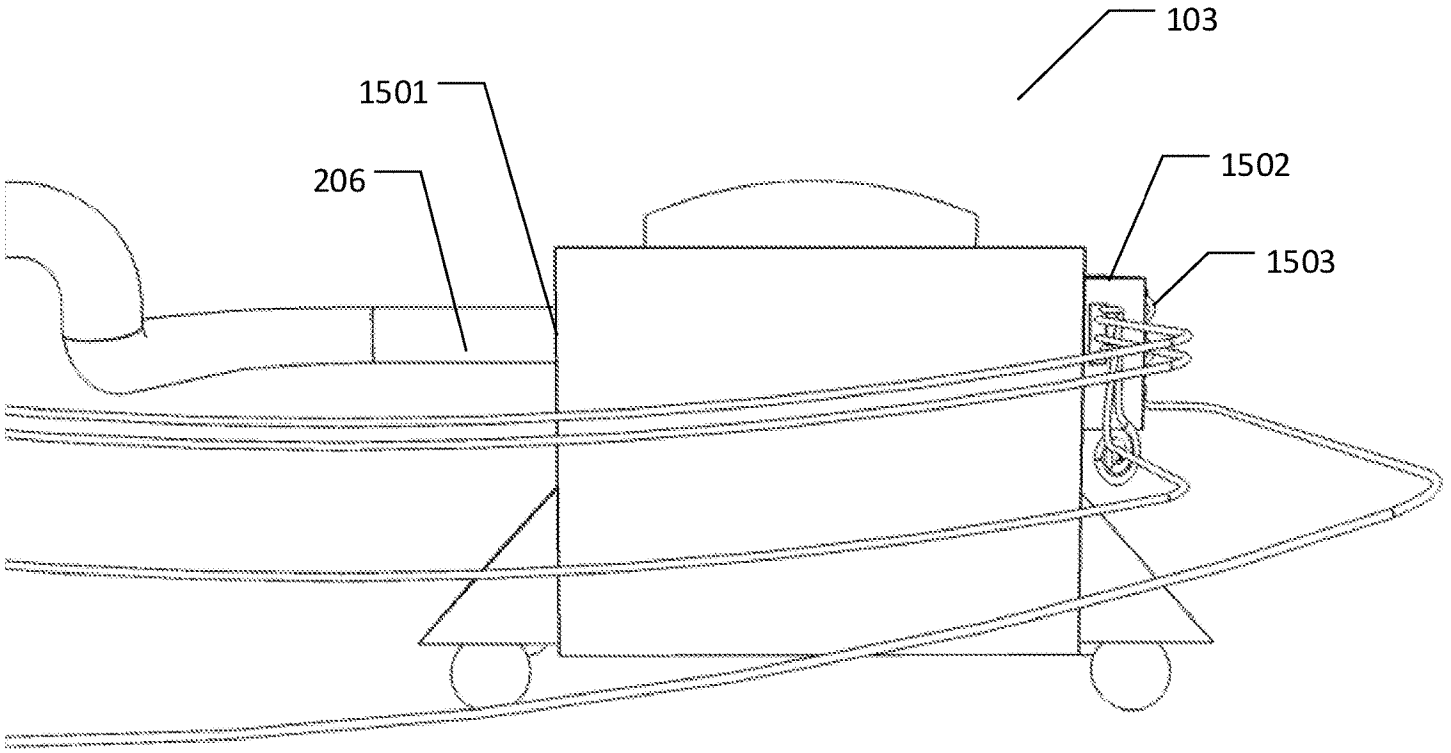
FIG. 15 illustrates a dust collector.

FIG. 15 illustrates a dust collector 103 comprising a vacuum hose opening 1501, an electrical junction box 1502, a plurality of pulsators 1503, and internal components such as an air compressor 1504, vacuum pump and filters 1505. Vacuum hose opening 1501 can be a hole in dust collector 103 that is connectable with vacuum hose 206. Electrical junction box 1502 can comprise a power supply 1506 that is capable of providing power to paint stripping system 100 components such as blaster 101, buggy 102, and pulsators 1503. Pulsators 1503 can produce pulsating air that is used for filtering the materials collected by dust collector 103. Air compressor 1504 can operate air feeds of blaster 101 and can be used to clean filters 1505. In a preferred embodiment, a SCFM air compressor 1504 can be used. Furthermore, dust collector 103 can comprise wheel 1409 that can allow dust collector 103 to be easily maneuvered.

Figure 16:
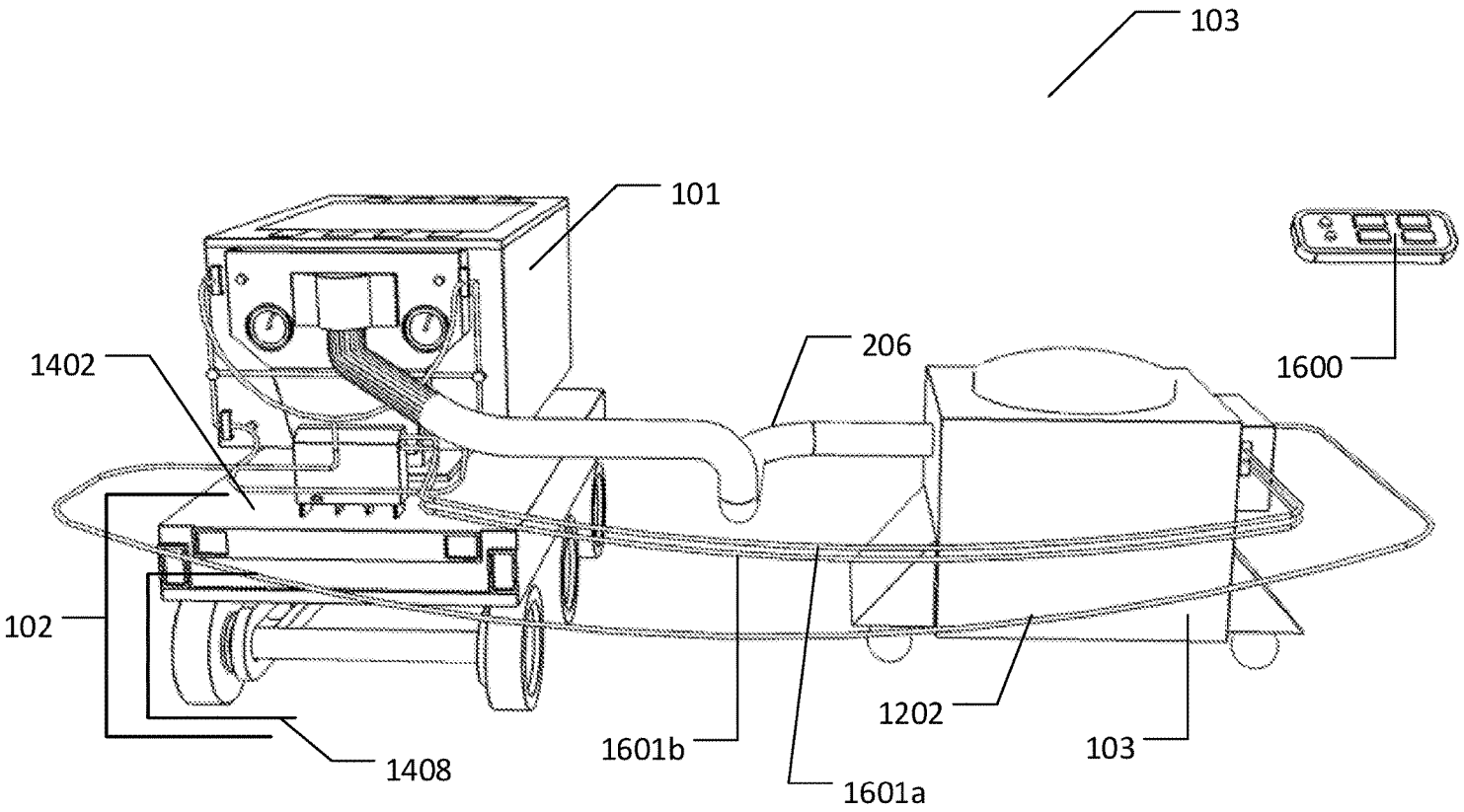
FIG. 16 illustrates how components of a paint stripping system are connected.

FIG. 16 illustrates how components of paint stripping system 100 are connected and controlled through one or more remote controls 1600. Blaster 101 can be mounted to buggy 102 using mounting brackets. In this embodiment, blaster-mounting bracket 1204 can be attached to platform-mounting bracket 1404. In one embodiment, first fasteners 1205 can be attached to second fasteners 1405 through turnbuckles. Blaster 101 can be connected to dust collector 103 through vacuum hose 206, air supply hose 1202, and a plurality of power cords 1601. A blaster power cord 1601*a* for blaster 101, a buggy power cord 1601*b* for buggy 102, and a pulsator power cord 1601*c* for pulsators 1503 can be connected to electrical junction box 1502. As an example, each power cord 1601 that connects blaster 101 and dust collector 103 can reach up to 100 foot. Moreover, a dust collector power cord 1601*d* that can be used to transmit power to dust collector 103 and can reach up to 150 foot. Air supply hose 1202 from blaster 101 can be connected to pulsators 1503 on dust collector 103.

In one embodiment, a single remote control 1600 can be used to control scissor lift 1402, and steering system 503. In such embodiment, remote control 1600 can be used to operate actuator 1408, which can expand, and/or retract scissor lift 1402. Additionally, remote control 1600 can also be used to steer and drive buggy 102 to a desired location. In another embodiment separate remote controls 1600 can be used to control scissor lift 1402 and steering system 1403.

Figure 17:
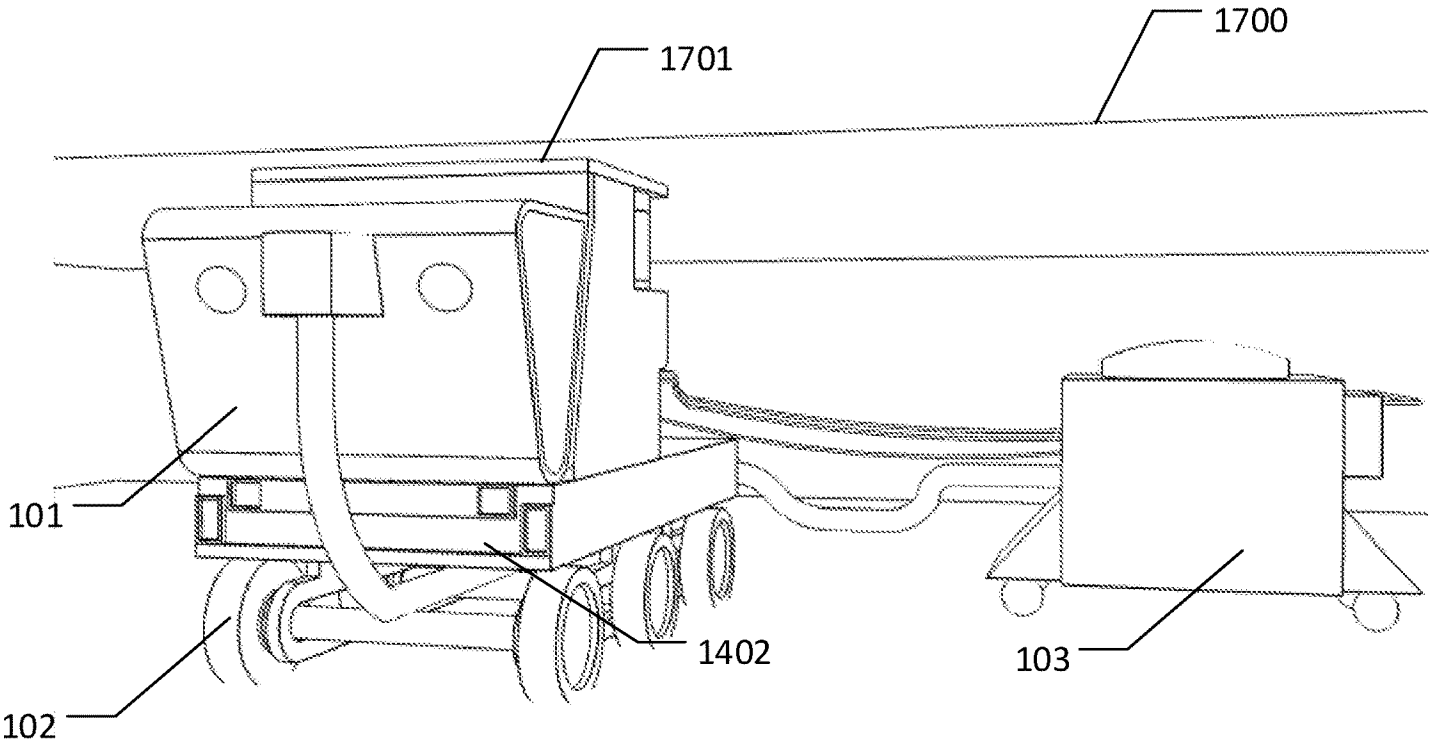
FIG. 17 illustrates a paint stripping system positioned under the bottom of a ship.

FIG. 17 illustrates paint stripping system 100 positioned under the bottom of a ship 1700. After positioning paint stripping system 100 under ship 1700, fourth power cord 1601*d* can be connected to an external power source. Using remote control 1600, scissor lift 1402 can be adjusted to a desired height, or until top surface of blaster 101 reaches a desired overhead surface 1701. Turnbuckles 1406 can also be adjusted to make upper seal 204 flushed with overhead surface 1701. Once blaster 101 reaches overhead surface 1701, paint stripping system 100 can be turned on to start operation.

Figure 18:
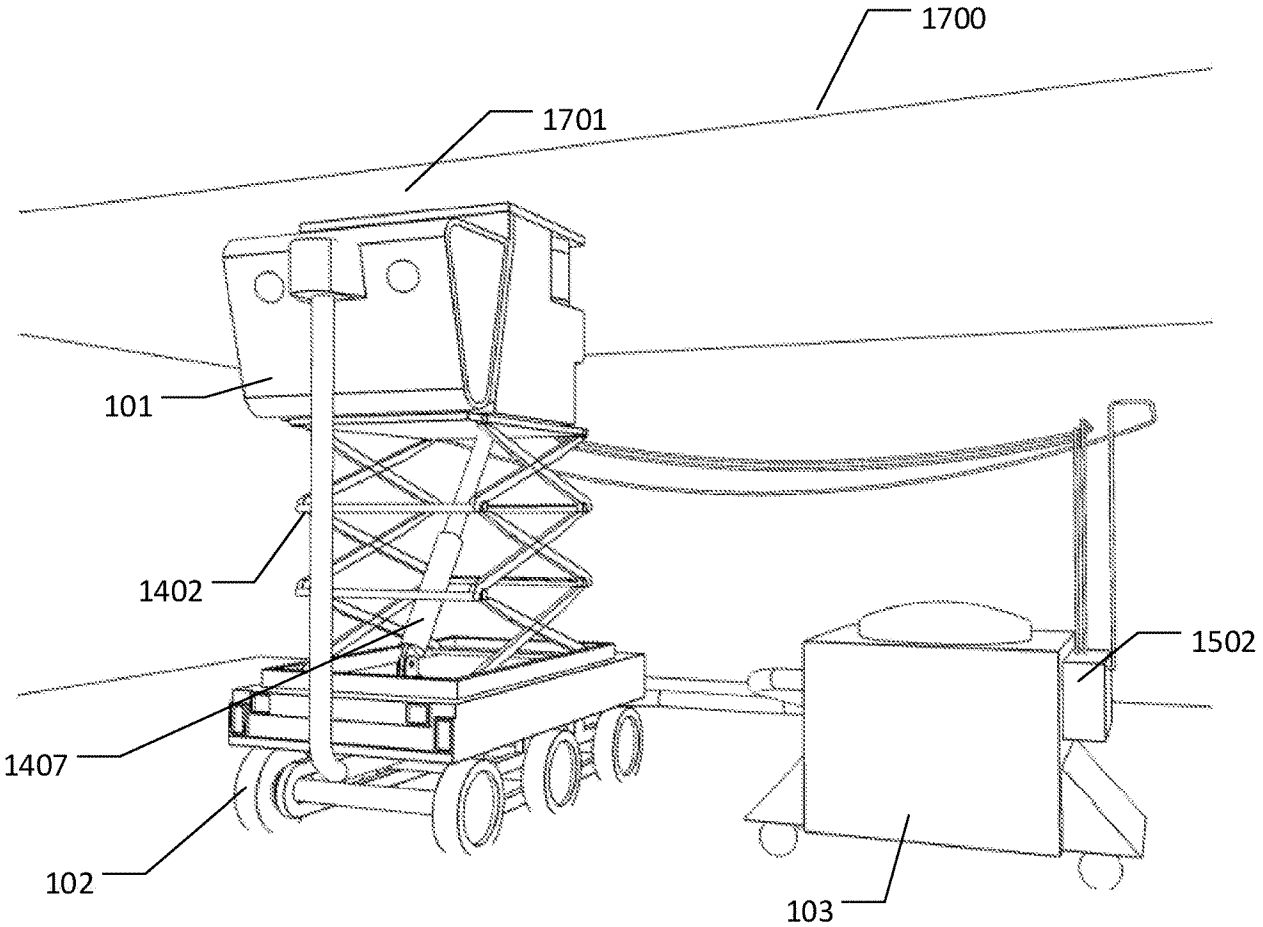
FIG. 18 illustrates a scissor lift at an extended position.

FIG. 18 illustrates scissor lift 1402 at an extended position. In a preferred embodiment, the height of paint stripping system 100 cannot exceed 5 ft. when retracted, while at an extended position maximum height can reach 8 ft. Further, once blaster 101 is adjusted to a desired position, blaster 101 can be turned on at electrical junction box 1502. Overhead surface 1701 can then be blasted using blaster 101. Remote control 1600 can be used to drive and steer buggy 102. As such, blaster 101 can be positioned and steered continuously while blasting overhead surface 1701.

As blaster 101 propels the abrasive material towards overhead surface 1701, the waste material and the released abrasive materials can then be collected within second enclosure 302 through upper seal 204. As propeller assembly 600 releases the abrasive materials, the abrasive materials thrown can be collected by left recirculator 500*a*, and right recirculator 500*b* through insert 506. The abrasive materials can then be released again from neck 502 of each recirculator 500. This process can produce a funnel-shaped rotating air within second enclosure 302. The waste material, can be pulled out of the rotating air and can go through recirculators 500. The debris can be drawn into first enclosure 301 and can go through dust vent 303. From dust vent 303, the debris can go through vacuum hose 206 and into dust collector 103. The debris is collected and is filtered within dust collector 103. After the debris is filtered through vacuum pump and filter 1505, the collected waste can be dumped into the waste container of dust collector 103. Once the waste container is full, the waste container can be removed to dispose the debris.

Simultaneously, the abrasive material produced during operation can be recovered within second enclosure 302 and then goes back to each recirculator 500 to be recycled. As the abrasive materials is sent back into recirculator 500, the abrasive material can curve around first enclosure 301 and be thrown towards the center. Deflector shield 1001 of dust vent 303 can slow down the momentum of the abrasive material. The gravity can then help facilitate with refeeding the abrasive material into propeller assembly 600. In some cases wherein some obstacle prevents the abrasive material from being recycled, the abrasive material can collect within bottom cavity 504 and within gaps 702. When paint stripping system 100 needs new abrasive material, third loader valve 1203*c* on shot box 1201 can load additional abrasive material to first enclosure 301.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A blaster system comprising a first enclosure comprising a pair of primary ports at the front surface of said first enclosure, said primary ports capable of receiving abrasive material; and a pair of control cages attached at the bottom surface of said first enclosure forming a pair of curved surfaces, and a plurality of gaps, each of said curved surface comprising a slot, each end of said slot rests within each of said gaps such that said abrasive material received within said first enclosure collects within said gaps and falls into said slot;

a second enclosure attached to said first enclosure, said second enclosure comprising an upper seal capable of collecting used abrasive material and waste material from an overhead surface; and a bottom opening;

a pair of recirculators, each of said recirculator comprising a hook capable of attaching said recirculators at the top opposite sides of said first enclosure;

a neck connected below said hook, said neck comprising an outlet port facing towards inner surface of said first enclosure, said outlet port capable of releasing said collected abrasive material back to said first enclosure; and a bottom cavity at the bottom of said recirculators, said bottom cavity comprising an inlet port positionable under said bottom opening, said inlet port capable of receiving collected abrasive material from said second enclosure;

a pair of loader valves, each of said loader valve within said bottom cavity of each of said recirculator, said loader valves capable of directing said abrasive material from said inlet port into said outlet port; and a pair of propeller assemblies each mounted within each of said control cages, said propeller assemblies comprising a chamber opening positioned under said slot, said chamber opening capable of releasing said abrasive material within said second enclosure;

a propeller placed within said second enclosure that propels said abrasive material released from said chamber opening; and a pair of electric motor assemblies capable of actuating said propeller.

2. The blasting system of claim 1 further comprising a shot box that holds additional abrasive material, said shot box comprising a third loader valve; and a plurality of air supply hoses comprising a recycling hose, one end of said recycling hose connects to said third loader valve;

a plurality of y-connectors comprising a first y-connector that connects said neck of each of said pair of recirculators with the other end of said recycling air hose;

a second y-connector that connects said neck and said loader valve on one of said pair of recirculators with said recycling hose;

a third y-connector that connects said neck and said loader valve on the other said pair of recirculators with said recycling hose.

3. The system of claim 2 wherein said shot box pneumatically loads said additional abrasive material to said first enclosure.

4. The system of claim 1 further comprising
a dust vent at the front surface of said first enclosure; and
a vacuum hose that connects said dust vent to a dust collector, said dust collector capable of receiving and filtering waste material from said blaster.

5. The system of claim 4 further comprising a deflector shield placed within the center of said first enclosure capable of enclosing said dust vent, further wherein said deflector shield capable of slowing down said abrasive material that goes within said first enclosure.

6. The system of claim 4 wherein said dust collector can comprise
an electrical junction box capable of providing power to said blaster; and
air compressor that connects to said air supply hoses.

7. The system of claim 1 wherein said blaster system mountable to a buggy, said buggy capable of maneuvering said blaster system to a desired direction.

8. The system of claim 1 wherein each of said electric motor assembly is powered by 30 HP motor.

9. The system of claim 1 wherein said abrasive material can comprise shot and grit.

10. A method of operating a blaster system comprising the steps of
positioning said blaster system under an overhead surface, wherein said blaster system comprises
a first enclosure comprising
a pair of primary ports at the front surface of said first enclosure, said primary; and
a pair of control cages attached at the bottom surface of said first enclosure forming a pair of curved surfaces, and a plurality of gaps, each of said curved surface comprising a slot, each end of said slot rests within each of said gaps such that said abrasive material received within said first enclosure collects within said gaps and falls into said slot;
a second enclosure attached to said first enclosure, said second enclosure comprising
an upper seal at the top surface of said second enclosure; and
a bottom opening;
a pair of recirculators, each of said recirculator comprising
a hook capable of attaching said recirculators at the top opposite sides of said first enclosure;
a neck connected below said hook, said neck comprising an outlet port facing towards inner surface of said first enclosure, said outlet port capable of releasing said collected abrasive material back to said first enclosure; and
a bottom cavity at the bottom of said recirculators, said bottom cavity comprising an inlet port positionable under said bottom opening, said inlet port capable of receiving collected abrasive material from said second enclosure;
a pair of propeller assemblies each mounted within each of said control cages, said propeller assemblies comprising
a chamber opening positioned under said slot, said chamber opening capable of releasing said abrasive material within said second enclosure;
a propeller placed within said second enclosure that propels said abrasive material released from said chamber opening; and
a pair of electric motor assemblies capable of actuating said propeller; and
loading said abrasive material into said primary port;
turning on said blaster system to blast said overhead surface;
receiving said waste material and said used abrasive material through said upper seal;
receiving said used abrasive material on said inlet port positioned at the bottom of said second enclosure;
directing said used abrasive material to said outlet port positioned at the opposite top side of said first enclosure through said loader valves on each of said recirculators; and
reloading said used abrasive material on said slot.

11. The method of claim 10 wherein after loading said abrasive material on said primary port further comprising the step of directing said abrasive material onto said slot through said gaps at the bottom of first enclosure.

12. The method of claim 10 wherein turning on said blaster system allows said propeller assemblies to release said abrasive material from said chamber opening.

13. The method of claim 12 after said abrasive material is released from said chamber opening comprises the step of hitting said abrasive material through a plurality of blades, further wherein hitting said abrasive material causes said abrasive material to be thrown in
upwards direction that causes said abrasive material to hit said overhead surface; and
downwards direction that directs said abrasive material into said inlet port of said recirculators.

14. The method of claim 10 further a shot box, said shot box comprising a third loader valve capable of pneumatically loading said additional abrasive material into said first enclosure.

15. The method of claim 10 comprising the step of mounting said blaster system to a buggy, said buggy capable of maneuvering said blaster system to a desired direction.

16. The method of claim 10, wherein during blasting operation a funnel-shaped rotating air is produced within said first enclosure, said waste materials are then pulled out of the rotating air through said recirculators onto a dust vent.

17. The method of claim 16 wherein said dust vent comprises a vacuum hose, said vacuum hose connects to a dust collector capable of collecting said waste materials from said blaster system.

18. The method of claim 10 wherein said abrasive material comprises shot and grit.

19. The method of claim 1 wherein said overhead surface comprises a bottom of a ship.

* * * * *